US009815274B2

(12) United States Patent
Murasawa et al.

(10) Patent No.: US 9,815,274 B2
(45) Date of Patent: Nov. 14, 2017

(54) IMAGE RECORDING APPARATUS AND CONTROL METHOD THEREFOR

(71) Applicant: CANON KABUSHIKI KAISHA, Tokyo (JP)

(72) Inventors: Kouta Murasawa, Yokohama (JP); Shinichi Miyazaki, Kawasaki (JP); Yusuke Hashii, Tokyo (JP); Yugo Mochizuki, Kawasaki (JP); Mayuko Yamagata, Inagi (JP); Akitoshi Yamada, Yokohama (JP); Masao Kato, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/353,107

(22) Filed: Nov. 16, 2016

(65) Prior Publication Data

US 2017/0066233 A1 Mar. 9, 2017

Related U.S. Application Data

(63) Continuation of application No. 15/080,988, filed on Mar. 25, 2016, now Pat. No. 9,533,492.

(30) Foreign Application Priority Data

Apr. 10, 2015 (JP) ..... 2015-081229

(51) Int. Cl.
*B41J 2/045* (2006.01)
*B41J 2/21* (2006.01)

(52) U.S. Cl.
CPC ..... *B41J 2/04536* (2013.01); *B41J 2/0451* (2013.01); *B41J 2/04586* (2013.01); (Continued)

(58) Field of Classification Search
CPC ..... B41J 2/04541; B41J 2/04543; B41J 2/04586; B41J 2202/20; B41J 2/0451; (Continued)

(56) References Cited

U.S. PATENT DOCUMENTS

| | | | | |
|---|---|---|---|---|
| 7,414,749 | B2 * | 8/2008 | Lapstun | B41J 2/00 358/1.1 |
| 8,958,114 | B2 | 2/2015 | Abello | |
| 2006/0071951 | A1 | 4/2006 | Walmsley | |

FOREIGN PATENT DOCUMENTS

| | | |
|---|---|---|
| JP | 4125717 | 5/2008 |
| WO | 03/094502 | 11/2003 |

* cited by examiner

*Primary Examiner* — Thinh H Nguyen
(74) *Attorney, Agent, or Firm* — Fitzpatrick, Cella, Harper & Scinto

(57) ABSTRACT

A dividing unit generates, from input data, divided data corresponding to the first area and the second area to be printed by a recording head and partly overlapping each other. The dividing unit supplies the respective divided data to the first processing unit and the second processing unit which can concurrently perform processing. Each of the first and second processing units generates the recording image data from the divided data based on a characteristic of the recording head corresponding to a recording area assigned to one of the processing units and a partial area assigned to the other processing unit. Each of the first and second processing units then performs driving control on the recording head based on data, in generated recording image data, which corresponds to an area recorded by one of the processing units.

26 Claims, 18 Drawing Sheets

(52) U.S. Cl.
CPC ..... *B41J 2/2139* (2013.01); *B41J 2/2142* (2013.01); *B41J 2/2146* (2013.01)

(58) Field of Classification Search
CPC .... B41J 2/04536; B41J 2/2139; B41J 2/2142; B41J 2/2146
See application file for complete search history.

IMAGE RECORDING APPARATUS AND CONTROL METHOD THEREFOR

This application is a continuation of application Ser. No. 15/080,988, filed on Mar. 25, 2016, which claims priority under §119 to Japan 2015-081229, filed on Apr. 10, 2015, the contents of each of which is incorporated by reference.

BACKGROUND OF THE INVENTION

Field of the Invention

The present invention relates to an image recording apparatus and a control method therefor.

Description of the Related Art

Recently, faster printers have longer printheads. Some full-line printers have a printhead with a width corresponding to a print page to speed up printing. Such printers can print a large area at once and hence can speed up printing as compared with conventional printers of a type designed to reciprocate a recording head. Along with the development of such printers, demands have arisen for higher processing speeds of conversion from print data into recording image data for actual recording by a printhead. Parallelization is one of techniques used for an increase in this processing speed. As a parallelization method, a method of dividing a printing area is known. This method can cope with an increase in printing width by increasing a division number, and hence can provide a system with high scalability with respect to the elongation of the printheads of printers (for example, Japanese Patent No. 4125717).

The above method, however, sometimes causes processing discontinuity between divided areas. When performing print control using adjacent pixels, it is sometime impossible to perform proper control because of a lack of information for the control. For example, such control includes non-discharge complementation control to be performed when a printhead cannot discharge any ink. Conventional non-discharge complementation is performed by assigning recoding image data to adjacent nozzles. When, however, performing processing upon dividing an area, recording image data cannot sometimes be assigned to adjacent nozzles, resulting in image quality deterioration such as white streaking. This problem causes serious image quality deterioration, in particular, in a full multi-printer designed to print on a printing area only once.

As a solution for such discontinuity, a method of sharing a memory is known. In this method, as the number of parallel operations increases, the amount of access to data in the memory per unit time multiplies. This may cause a decrease in processing speed. Consider, for example, a case in which each circuit for quantizing multi-valued image data requires a memory access data amount per unit time as 600 MBytes/sec. In this case, if the number of quantization circuits is increased to three to increase the number of parallel operations, it requires three times the access data amount, that is, 1,800 MBytes/sec. In practice, the accessible band of the memory has its own limit. Even if, therefore, the number of parallel operations is increased, a wait time for data acquisition from the memory occurs. That is, there is a limit to an increase in speed in accordance with an increase in the number of parallel operations.

SUMMARY OF THE INVENTION

The present invention has been made in consideration of the above problem. According to an aspect of the invention, there is provided an image recording apparatus comprising:

a recording head configured to record an image by discharging ink onto a recording medium; a first processing unit configured to perform processing of generating recording image data of a first area to be recorded by the recording head and processing of performing driving control on a corresponding part of the recording head for recording on the first area; a second processing unit configured to perform processing of generating recording image data of a second area to be recorded by the recording head and processing of performing driving control on a corresponding part of the recording head for recording on the second area, the second processing unit being configured to operate concurrently with the first processing unit; a dividing unit configured to generate, from input data, divided data corresponding to the first area and the second area and partly overlapping each other and supply the respective divided data to the first processing unit and the second processing unit; and a detection unit configured to detect a recording characteristic of the recording head, wherein each of the first processing unit and the second processing unit includes a generation unit configured to generate the recording image data from the divided data based on a characteristic of the recording head corresponding to an area whose processing is assigned to one of the processing units and a partial area whose processing is assigned to the other processing unit, and a control unit configured to perform driving control on the recording head based on data, in generated recording image data, which corresponds to an area whose processing is assigned to one of the processing units.

According to the present invention, it is possible to reduce image deterioration without decreasing a processing speed even in a case in which image data for printing is divided into areas, and each processing unit performs print processing based on print data of each divided area.

Further features of the present invention will become apparent from the following description of exemplary embodiments (with reference to the attached drawings).

DESCRIPTION OF THE EMBODIMENTS

The embodiments of the present invention will be described in detail below with reference to the accompanying drawings.

First Embodiment

Figure 1:
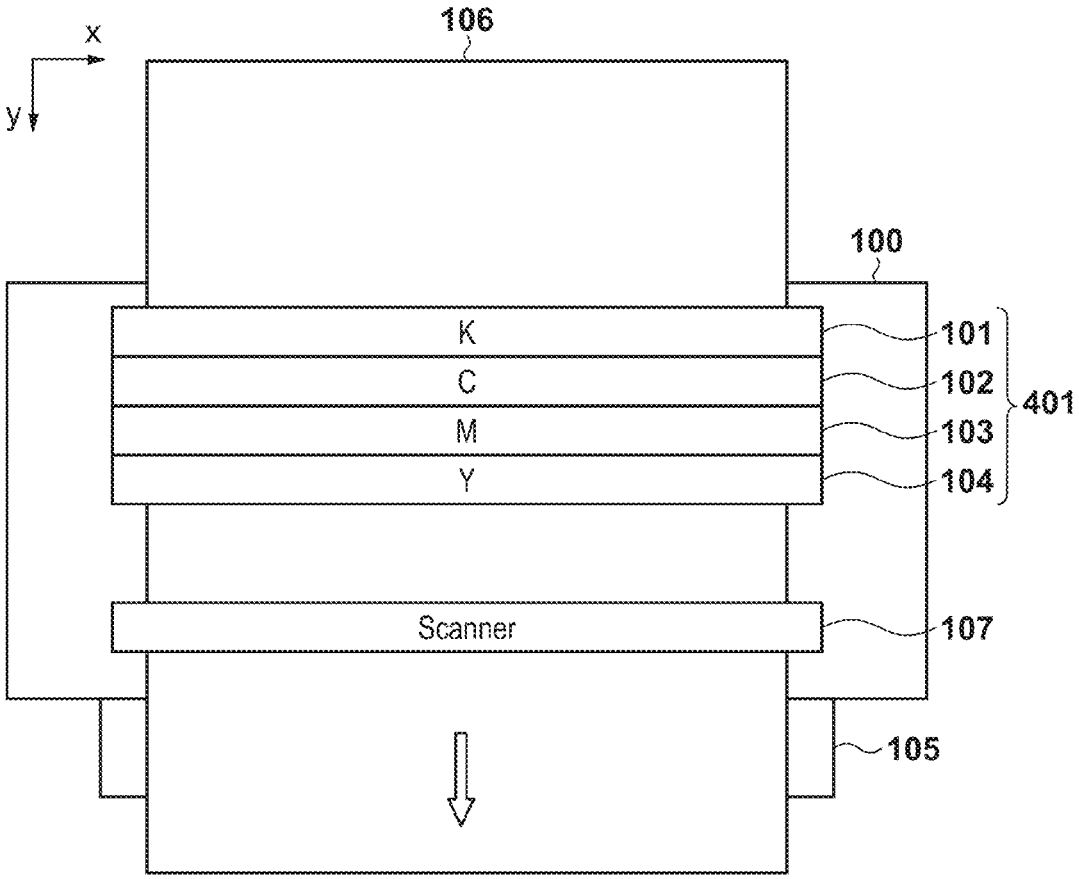
FIG. 1 is a view schematically showing an inkjet printer according to an embodiment.

FIG. 1 is a view schematically showing a printer 100 as an inkjet recording apparatus according to the first embodiment. The printer 100 according to the embodiment is a full-line type recording apparatus, and includes recording heads 101 to 104, as shown in FIG. 1. Each of the recording heads 101 to 104 includes a nozzle array of a plurality of nozzles which correspond to the width of a recoding medium 106 and discharge the same type of ink. The nozzle array has nozzles arrayed in the x-axis direction in FIG. 1 at a pitch of 1,200 dpi. The recording heads 101 to 104 are recording heads which respectively discharge black (K), cyan (C), magenta (M), and yellow (Y) inks. The recording heads 101 to 104 which discharge these different types of inks are arranged in parallel in the y-axis direction in FIG. 1. Reference numeral 401 in FIG. 1 generically denotes the recording heads 101 to 104, which will be referred to as the recording head unit 401 hereinafter.

Figure 2:
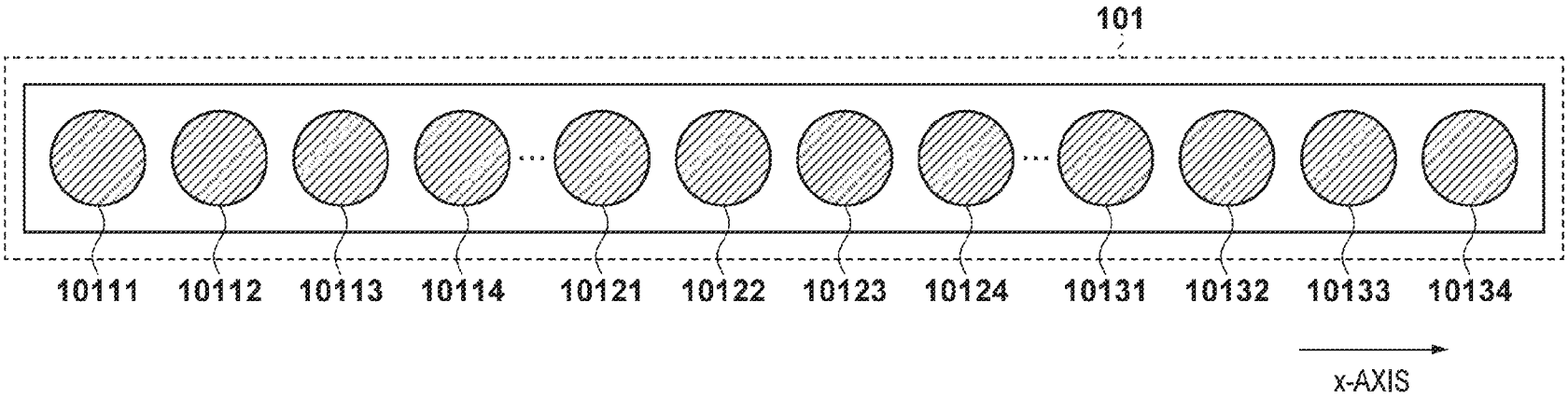
FIG. 2 is a view for explaining the arrangement of a recording head according to the embodiment.

FIG. 2 is a view showing the nozzle array of the recording head 101. As shown in FIG. 2, the recording head 101 has a structure with one nozzle array extending in the nozzle array direction. This nozzle array includes nozzles 10111 to 10134. Black ink is supplied to the recording head 101. Like the recording head 101, the remaining recording heads 102 to 104 each have a nozzle array along the x-axis. However, a difference between them is that cyan ink, magenta ink, and yellow ink are respectively supplied to the recording head 102, the recording head 103, and the recording head 104.

Referring back to FIG. 1, the recoding medium 106 is conveyed in the y-axis direction in FIG. 1 as a convey roller 105 (and other rollers (not shown)) is rotated by the driving force of a motor (not shown). While the recording medium 106 is conveyed, each nozzle in the recording heads 101 to 104 performs a discharging operation based on recording data at a frequency corresponding to the conveying speed of the recoding medium 106. With this operation, dots of the respective colors are recorded at a predetermined resolution corresponding to the recording data, thereby forming a one-page image on the recoding medium 106.

A scanner 107 having reading elements arrayed at a predetermined pitch is arrayed at a position downstream of the recording heads 101 to 104 in the y-axis direction while being arrayed in parallel with the recording heads 101 to 104. The scanner 107 can read an image recorded by the recording heads 101 to 104 and output the read image as RGB multi-valued data (for example, 8 bits=256 tones per color component).

Figure 3:
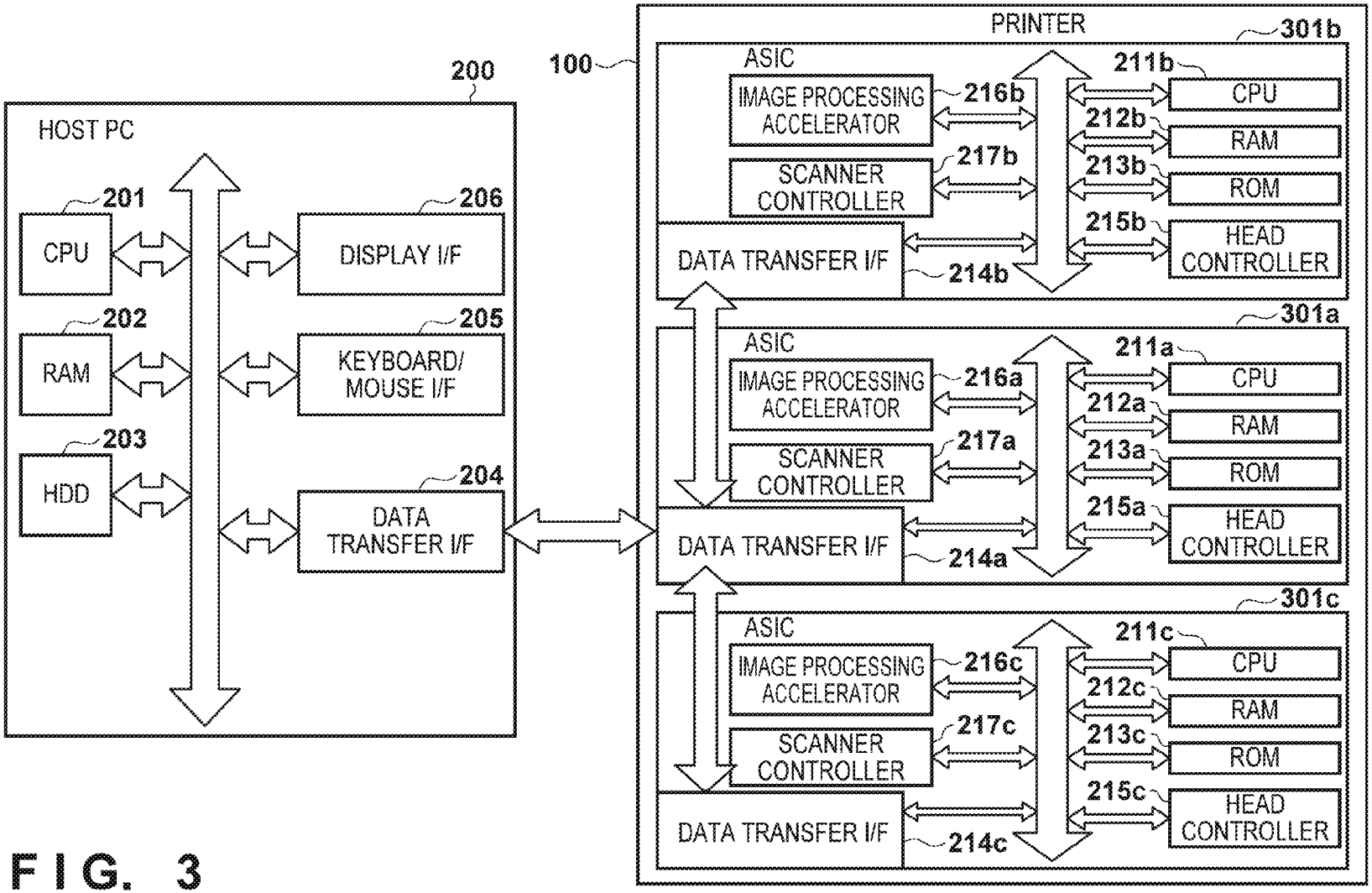
FIG. 3 is a block diagram showing a recording system according to the embodiment.

FIG. 3 is a block diagram showing a recording system according to the first embodiment. As shown in FIG. 3, this recording system is constituted by the printer 100 shown in FIG. 1 and a personal computer (to be referred to as a host PC hereinafter) 200 as a host apparatus of the printer.

The host PC 200 mainly includes the following elements. A CPU 201 executes processing in accordance with programs held in an HDD 203 and a RAM 202 as storage units. The RAM 202 is a volatile storage which temporarily holds programs and data. The HDD 203 is a nonvolatile storage which holds programs and data, like the RAM. In this embodiment, a data transfer I/F (interface) 204 controls communication of data with the printer 100. As a connection scheme for this data communication, a USB, IEEE1394, LAN, or the like can be used. A keyboard/mouse I/F 205 is an I/F which controls an HID (Human Interface Device) such as a keyboard or mouse. The user can perform an input operation via this I/F. A display I/F 206 controls display on a display (not shown).

The printer 100 includes ASICs (Application Specific Integrated Circuits) 301*a*, 301*b*, and 301*c* as processing units. The ASICs 301*a*, 301*b*, and 301*c* have the same arrangement. For this reason, the ASIC 301*a* will be described below.

The ASIC 301*a* mainly includes the following elements. A CPU 211*a* executes processing in each embodiment (to be described later) in accordance with programs held in a ROM 213*a* and a RAM 212*a*. The RAM 212*a* is a volatile storage which temporarily holds programs and data. The ROM 213*a* is a nonvolatile storage which can hold table data and programs to be used for processing (to be described later).

A data transfer I/F 214*a* controls data communication with the host PC 200. In addition, the data transfer I/F 214*a* also controls data transfer between a data transfer I/F 214*b* of the ASIC 301*b* and a data transfer I/F 214*c* of the ASIC 301*c*.

As described above, a USB, LAN, IEEE1394, or the like is used for data communication between the host PC 200 and the ASIC 301*a*. Assume that communication between the ASIC 301*a* and the ASIC 301*c* is performed by using a bus, a communication protocol, and a data format which are different from those used for communication with the host PC 200. For example, communication between ASICs is performed by using a bus such as PCI Express having a sufficiently higher speed than a bus used for communication between the host PC and each ASIC. Alternatively, a memory bus may be directly connected to ASICs for communication. Directly connecting the bus can increase the communication speed between the ASICs.

A head controller 215*a* controls discharging operations of the recording heads 101 to 104 shown in FIG. 1 while supplying recording data to them. More specifically, the head controller 215*a* can be configured to read control parameters and recording data from predetermined addresses in the RAM 212*a*. When the CPU 211*a* writes the control parameters and recording data at the above predetermined addresses in the RAM 212*a*, the head controller 215*a* activates processing to cause the recording heads 101 to 104 to discharge inks. A scanner controller 217*a* controls each reading element of a scanner 107*a* shown in FIG. 1 and outputs RGB data obtained from the reading elements to the CPU 211*a*.

An image processing accelerator 216*a* is hardware which can execute image processing at a higher speed than the CPU 211*a*. More specifically, the image processing accelerator 216*a* is configured to read parameters and data required for image processing from predetermined addresses in the RAM 212*a*. When the CPU 211*a* writes the above parameters and data at the predetermined addresses in the RAM 212*a*, the image processing accelerator 216*a* is activated to perform predetermined image processing for the above data. In this embodiment, the image processing accelerator 216*a* performs image processing by hardware processing when performing a recording operation including quantization processing. Note that the image processing accelerator 216*a* is not an essential element, and creation processing for the above table parameters and image processing may be executed by only processing by the CPU 211*a*.

Although the constituent elements 211*a* to 217*a* of the ASIC 301*a* have been described above, the same applies to constituent elements 211*b* to 217*b* of the ASIC 301*b* and constituent elements 211*c* to 217*c* of the ASIC 301*c*. Note however that the data transfer I/F 214*b* of the ASIC 301*b* and the data transfer I/F 214*c* of the ASIC 301*c* need not have connection functions for the host PC 200. Alternatively, the use of such functions is inhibited. In addition, assume that specialized programs are respectively stored in the ROMs 213*a*, 213*b*, and 213*c* in the ASICs 301*a* to 301*c*.

Figure 4:
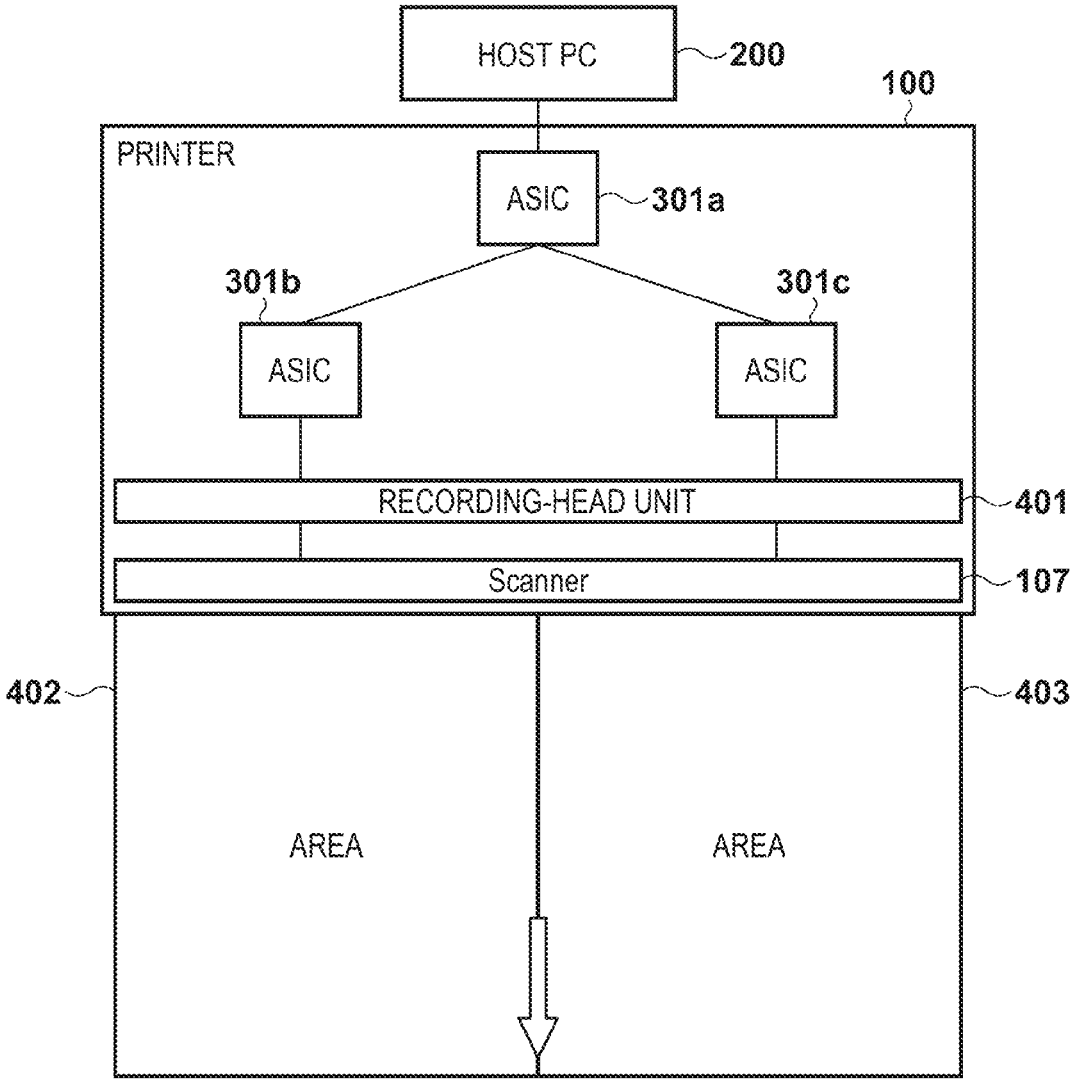
FIG. 4 is a block diagram showing the parallelization of printer control circuits based on area division according to the embodiment.

FIG. 4 is a view showing parallelization of the printer control circuits based on area division according to this embodiment. Note that referring to FIG. 4, a recording-head unit 401 (see FIG. 1) is a generic name of the four recording heads 101 to 104 described above. The ASIC 301*a* connected to host PC 200 functions as a controller for controlling the overall printer. In contrast to this, the ASICs 301*b* and 301*c* are in charge of image processing.

The ASIC 301*a* receives print data (multi-valued image data in the sRGB format in this embodiment) transmitted from the host PC 200. The ASIC 301*a* then divides the input data according to predetermined areas, and distributes (transmits) the print data in the respective areas to the ASICs 301*b* and 301*c* connected to the recording-head unit 401. In this case, the predetermined areas are printing areas in which image formation is performed by nozzles to be respectively controlled by the ASICs 301*b* and 301*c*, and are areas divided in a direction orthogonal to the array direction of nozzles, like areas AREA 402 and AREA 403. The ASICs 301*b* and 301*c* respectively receive the divided print data in their charge, and temporarily store the divided print data in local RAMS 212*b* and 212*c*. Since the ASICs 301*b* and 301*c* are independent of each other, they can concurrently process the divided print data stored in the local RAM 212*b* and 212*c*. The ASICs 301*b* and 301*c* then generate recording image data to be recorded by the recording-head unit 401 from the stored print data. Image processing accelerators 216*b* and 216*c* perform this recording image data generation processing. The image processing accelerators 216*b* and 216*c* perform the same processing. For this reason, processing performed by the image processing accelerator 216*b* will be described, and a description of the image processing accelerator 216*c* will be omitted.

The image processing accelerator 216*b* converts print data (print data in the area AREA 402) as multi-valued image data in the sRGB format stored in the RAM 212*b* into multi-valued image data in a YMCK recording color space. The image processing accelerator 216*b* quantizes the converted YMCK multi-valued image data, and writes back the quantized YMCK image data as recording image data in the RAM 212*b*. Each nozzle provided in the recording heads 101 to 104 according to this embodiment is controlled by a binary value indicating whether to discharge ink or not. Therefore, the above quantization processing can be regarded as binarization processing. As typical binarization methods, there are known techniques such as a dither method using a dither matrix and an error diffusion method. The following description is based on the assumption that the dither method is used.

Figure 6:
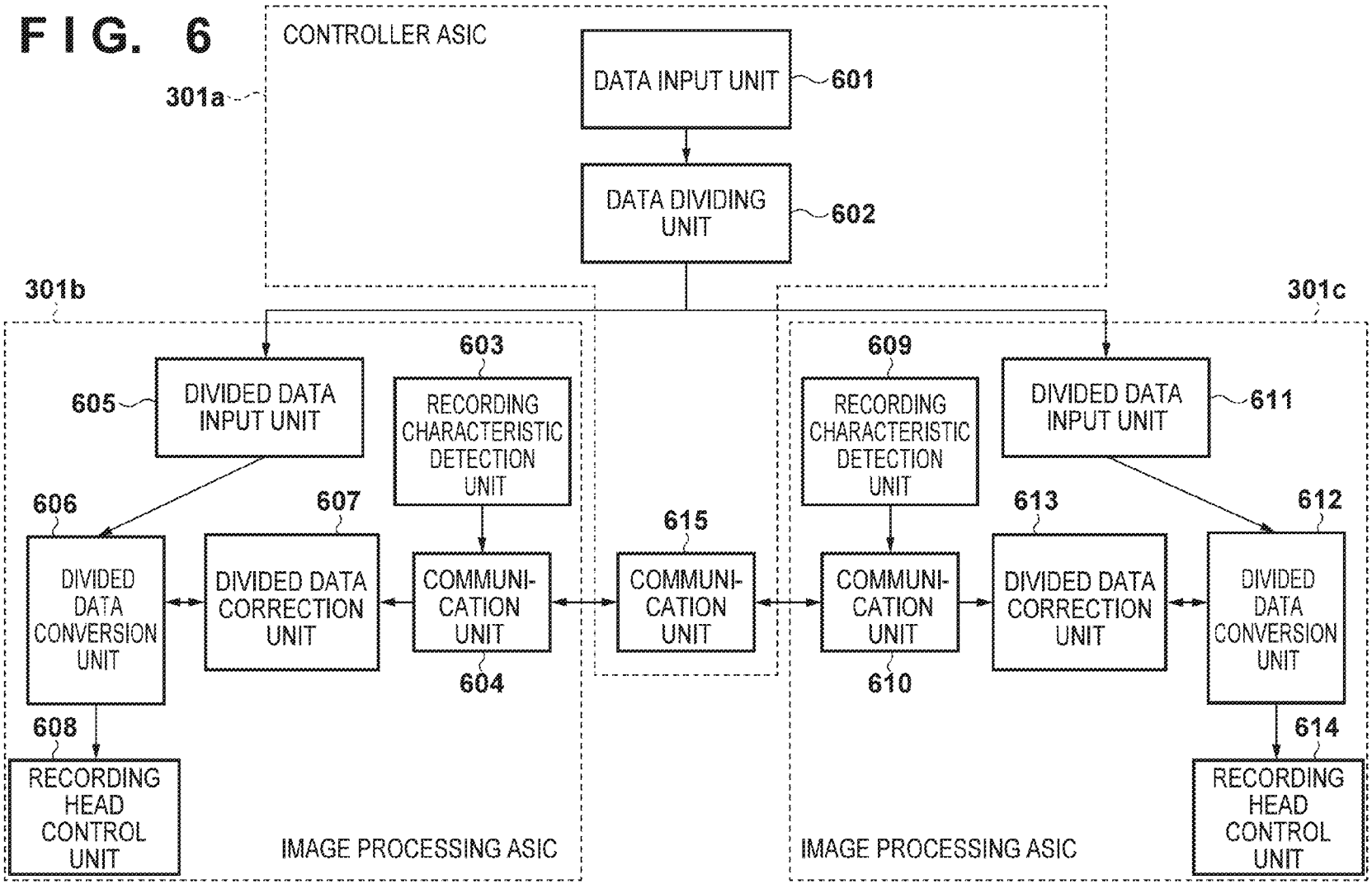
FIG. 6 is a block diagram showing a parallelization system based on area division according to the embodiment.

FIG. 6 is a functional block diagram of a parallelization system based on area division according to this embodiment. Each functional unit is implemented by making the CPU in each ASIC execute a program stored in the ROM.

The ASIC 301*a* functions as a controller which controls communication with the host PC 200 while controlling the remaining ASICs 301*b* and 301*c*. In the following description, therefore, the ASIC 301*a* will be referred to as the controller ASIC and the ASICs 301*b* and 301*c* will be referred to the image recording ASICs so as to be discriminated from each other.

The controller ASIC 301*a* includes a data input unit 601 which receives print data (sRGB multi-valued image data in this embodiment) from the host PC 200 via the data transfer I/F 214*a* and temporarily stores the data in the RAM 212*a*. The controller ASIC 301*a* also includes a data dividing unit 602 which divides the received print data into areas to be respectively processed by the ASICs 301*b* and 301*c* and distributes the divided data to the image recording ASICs 301*b* and 301*c*. In addition, the controller ASIC 301*a* includes a communication unit 615 (the data transfer I/F 214*a* serving the same function) for communication between the ASICs 301*b* and 301*c*.

Figure 7:
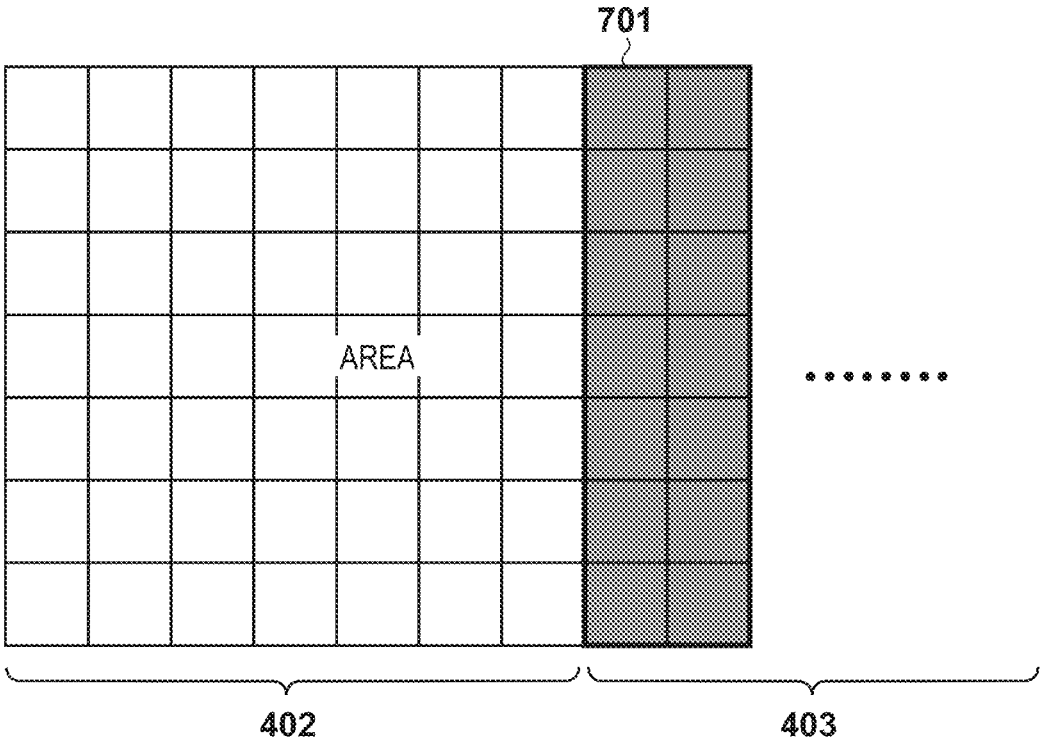
FIG. 7 is a view showing an area division method according to the embodiment.

Note that the divided print data supplied from the data dividing unit 602 to the ASICs 301*b* and 301*c* include an overlapping area corresponding to two pixels in the horizontal direction, as shown in FIG. 7. That is, the print data supplied to the image recording ASIC 301*b* includes, in addition to print data corresponding to the area AREA 402, an area 701 (corresponding to two pixels in the horizontal direction in FIG. 7) on the left end of the area AREA 403 next to the right of the area AREA 402. In addition, likewise, the print data supplied to the image recording ASIC 301*c* includes, in addition, print data corresponding to the area AREA 403, an area (also corresponding to two pixels in the horizontal direction) on the right end of the area AREA 402 next to the left of the area AREA 403.

Constituent elements 603 to 608 of the image recording ASIC 301*b* are substantially the same as constituent elements 609 to 614 of the image recording ASIC 301*c*. Therefore, the image recording ASIC 301*b* will be described below.

The recording characteristic detection unit 603 acquires information concerning the amounts of ink from the corresponding nozzles of the recording-head unit 401 which has performed recording on the area AREA 402 by making the scanner 107 read the recoding medium 106. The recording characteristic detection unit 603 then specifies the position of a discharge failure nozzle. More specifically, the recording characteristic detection unit 603 records a preset test pattern and reads it with the scanner 107 for each of color components of Y, M, C, and K, determines for each recorded color component whether there is any discharge failure nozzle, and specifies its position, if any. The communication unit 604 notifies the ASIC 301*c*, via the communication unit 604, the communication unit 615, and a communication unit 610, of the information obtained by the recording characteristic detection unit 603, that is, the information indicating whether there is any discharge failure nozzle and information indicating the recorded color component and the position of the corresponding nozzle, if any. The ASIC 301*c* also performs similar processing. As a result, all the ASICs (the two ASICs 301*b* and 301*c* in this embodiment) associated with the recording processing share the information concerning the discharge failure nozzle. The information obtained by the recording characteristic detection unit 603 and the information notified from another ASIC 301*c* are stored/held in the RAM 212*b*. Note that the ASIC 301*b* may separately incorporate a writable nonvolatile memory and write such information in it. In this case, the information is not lost even if the power supply is turned off unless recording processing for a test pattern is executed again.

As described above, the divided data input unit 605 receives divided print data (sRGB multi-valued image data) supplied from the controller ASIC 301*a* and temporarily stores the data in the RAM 212*b*. The divided data conversion unit 606 converts the divided print data stored in the RAM 212*b* into multi-valued data in a YMCK recording color space. This conversion may be performed by using matrix computation processing for RGB→YMCK conversion or a three-dimensional LUT. The divided data conversion unit 606 then quantizes (binarizes) the multi-valued data of the respective color components of Y, M, C, and K in the recording color space by using a dither matrix, and stores the binarization results as recording image data in the RAM 212*b*.

Note that the divided data conversion unit 606 may perform part or all of the above processing by using the image processing accelerator 216*b*. Using the image processing accelerator 216*b* can more speed up processing than by using the CPU 211*b*.

The divided data correction unit 607 corrects the recording image data (binary image data) generated by the divided data conversion unit 606 based on the information obtained via the communication unit 604, as needed (this correction processing will be described in detail later).

The RAM 212*b* stores recording image data corresponding to the area AREA 402 and recording image data corresponding to two pixels from the left end of the area AREA 403. The recording head control unit 608 reads out data corresponding to the area AREA 402, which is stored in the RAM 212*b*, and supplies the binary data to a head controller 215*b*, thereby performing drive control of the corresponding nozzles.

Correction processing by the divided data correction unit 607 according to this embodiment will be described next with reference to FIG. 17.

Figure 17:
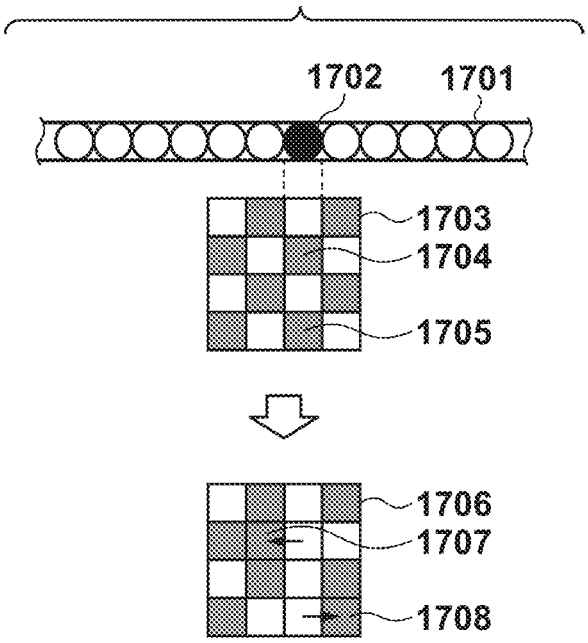
FIG. 17 is a view for explaining non-discharge nozzle complementation processing according to the first embodiment.

FIG. 17 shows the relationship between a recording head 1701 (one of the recording heads 101 to 104) and a binary pattern 1703 having undergone dither processing (quantization), which is to be recorded by the recording head 1701. The hatched portions in the binary pattern 1703 indicate dots to which ink is to be discharged, or in other words, data for driving nozzles. In addition, the blank portions indicate dots to which no ink is to be discharged, that is, data for inactivating nozzles. Furthermore, the horizontal direction in FIG. 17 corresponds to the x-axis direction in FIG. 1 (the array direction of the nozzles), and the vertical direction corresponds to the y-axis direction in FIG. 1 (the conveying direction of a recording medium).

Assume that a nozzle 1702 of the recording head 1701 is a discharge failure nozzle. In this case, although dots 1704 and 1705 in the binary pattern 1703 are recording targets for the discharge failure nozzle 1702, no ink is discharged in practice. The dither method is designed to express a density tone by the ratio of an actually recorded area (dot count) to a unit area. If, therefore, the dots 1704 and 1705 are not recorded, the density of the binary pattern 1703 does not reach an intended density.

If, therefore, there are the discharge dots 1704 and 1705 which should have been recorded by the discharge failure nozzle 1702, the divided data correction unit 607 according to this embodiment performs non-discharge complementation processing of moving these discharge dots to the positions of non-discharge dots (non-driving data) in data for nozzles which are adjacent to the discharge failure nozzle and can discharge ink, if any. As a result, the binary pattern 1703 is changed to a binary pattern 1706 in FIG. 17. Referring to FIG. 17, a dot 1707 indicates the moved dot 1704, and a dot 1708 indicates the moved dot 1705. Such dots are moved to the left and right at the same ratio. Such movement may be performed upon deciding positions in accordance with a specific pattern of a plurality of preset patterns, which matches a discharge failure nozzle. Note that if there are no non-discharge dots at positions adjacent to discharge dots assigned to a discharge failure nozzle, no movement is performed.

The above description has been made on correction processing by the divided data correction unit 607. A divided data conversion unit 612 of the ASIC 301*c* performs correction processing by using the same algorithm as that used by the divided data correction unit 607.

A case in which a discharge failure nozzle is accidentally located at the boundary position between the area AREA 402 and the area AREA 403 will be described below with reference to FIG. 8A.

Figure 8B:
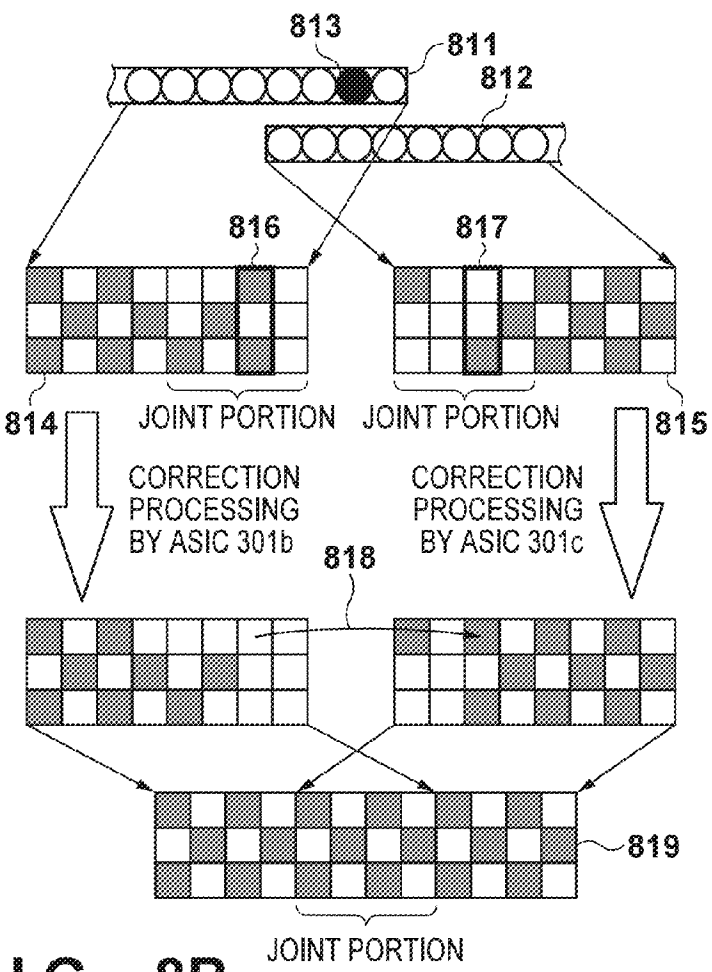
FIGS. 8A and 8B are views showing an example of non-discharge complementation in a parallelization system according to the first embodiment.
Figure 8A:
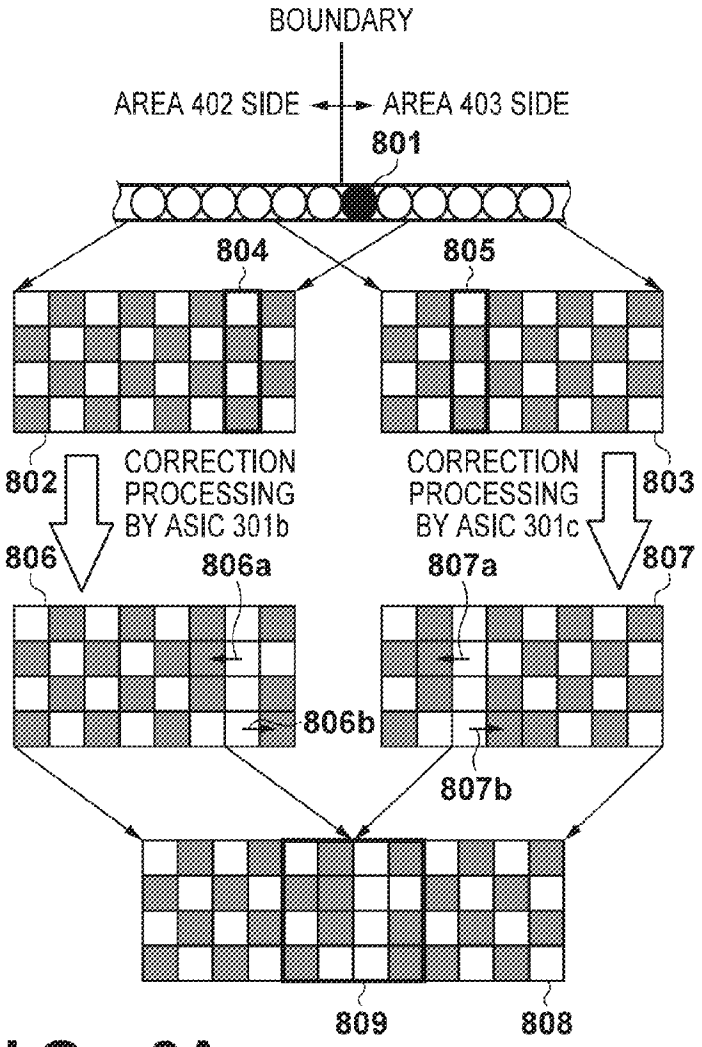

As shown in FIG. 8A, a discharge failure nozzle 801 belongs to the area AREA 403 recorded by the ASIC 301*c*. Note however that according to the above description, the divided data correction unit 607 in the ASIC 301*b* has also already known the presence and position of the discharge failure nozzle 801 from information received via the communication unit 604.

The divided data input unit 605 of the ASIC 301*b* receives print data of the area AREA 402 and print data of an area corresponding to two pixels on the left end of the area AREA 403 in the horizontal direction, and temporarily stores the data in the RAM 212*b*. The divided data conversion unit 606 generates recording image data 802 by performing color space conversion and quantization processing for the print data. The dots in a frame 804 in the recording image data 802 are to be recorded by the discharge failure nozzle 801.

Since the divided data correction unit 607 knows that the recording image data 802 includes dots to be recorded by the discharge failure nozzle 801, the divided data correction unit 607 performs non-discharge complementation processing described above with respect to the frame 804. As a result, the recording image data 802 is corrected into recording image data 806. That is, the dots in the frame 804 which indicate the discharge of ink are moved to arrows 806*a* and 806*b* in FIG. 8A. The recording head control unit 608 performs recording processing by controlling the recording-head unit 401 based on data belonging to the area AREA 402 in the recording image data 806 after the correction. That is, an area corresponding to two horizontal pixels from the right end of the recording image data 806 shown in FIG. 8A belongs to the area AREA 403, and hence becomes an area other than a recording target.

A divided data input unit 611 of the ASIC 301*c* receives the print data of the area AREA 403 and the print data of an area corresponding to two pixels on the right end of the area AREA 402 in the horizontal direction, and temporarily stores the data in the RAM 212*c*. A divided data conversion unit 612 generates recording image data 803 by performing color space conversion and quantization processing for the print data. The dots in a frame 805 in the recording image data 803 are to be recorded by the discharge failure nozzle 801. A divided data correction unit 613 performs non-discharge complementation processing described above with respect to the frame 805. As a result, the recording image data 803 is corrected into recording image data 807. That is, the dots in the frame 805 which indicate the discharge of ink are moved to arrows 807*a* and 807*b* in FIG. 8A. The recording head control unit 614 performs recording processing by controlling the recording-head unit 401 based on data belonging to the area AREA 403 in the recording image data 807 after the correction. That is, an area corresponding to two horizontal pixels from the left end of the recording image data 807 shown in FIG. 8A belongs to the area AREA 402, and hence becomes an area other than a recording target.

Figure 13:
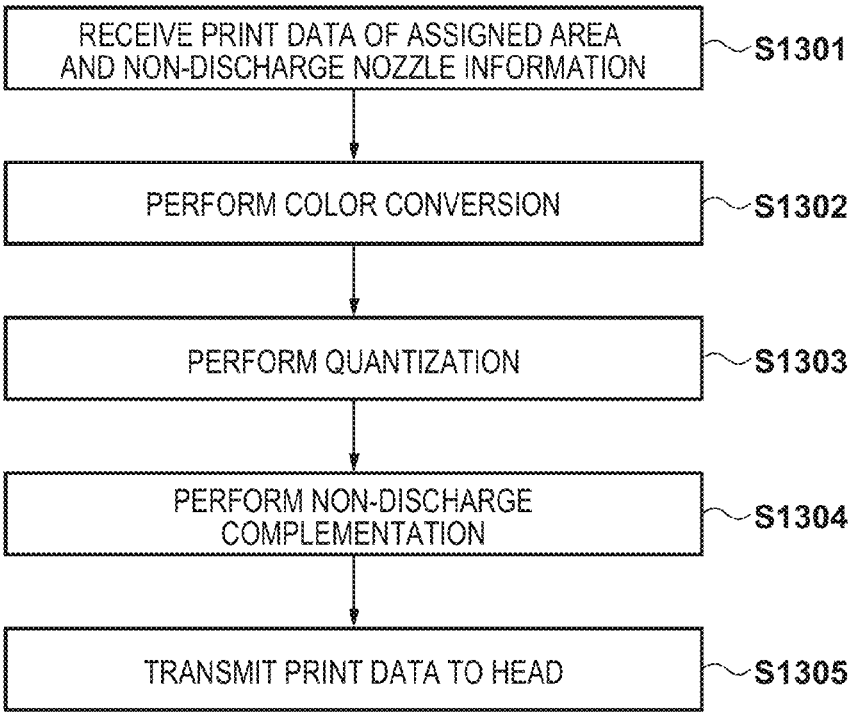
FIG. 13 is a flowchart for non-discharge complementation in the parallelization system according to the first embodiment.

FIG. 13 is a flowchart showing the contents of processing by the ASICs 301*b* and 301*c*. For the sake of convenience, the following description is based on the assumption that the ASIC 301*b* performs the processing.

In step S1301, the ASIC 301*b* receives the print data of an assigned area and discharge failure nozzle information. The assigned area is an area divided by the data dividing unit 602. This area corresponds to an area corresponding to two pixels on the left end of the area AREA 403 in addition to the area AREA 402. The discharge failure nozzle information includes discharge failure nozzle information detected by the recording characteristic detection unit 603 and discharge failure nozzle information received by the communication unit 604. In step S1302, the ASIC 301*b* converts the print data into data in the YMCK color space. In step S1303, the ASIC 301*b* generates recording image data by quantizing (binarizing in this embodiment) the print data converted in step S1302. The divided data conversion unit 606 performs processing in steps S1302 and S1303. In step S1304, non-discharge complementation processing is performed with respect to the recording image data quantized in step S1303. The divided data correction unit 607 performs this processing in step S1304. In step S1305, the recording image data having undergone non-discharge complementation in step S1304 is transmitted to the recording-head unit 401. The recording head control unit 608 executes this processing in step S1305. The ASIC 301*c* also performs similar processing.

As a result of the above processing, the ASICs 301*b* and 301*c* record a binary pattern 808 in FIG. 8A on the recording medium. The number of dots formed in an area 809 in a dither matrix including positions recorded by the discharge failure nozzle 801 is corrected to be approximate to the number of dots generated by the divided data conversion unit 606 or 612 at first, although not necessarily so, thereby facilitating maintaining a tone level.

As is also obvious from the above description, the ASICs 301*b* and 301*c* are independent of each other, and can concurrently execute conversion, quantization, and non-discharge complementation without interference. In addition, the ASICs 301*b* and 301*c* have already known information concerning the presence and position of a discharge failure nozzle by communicating with each other. Therefore, the ASICs 301*b* and 301*c* can reduce the influence of a discharge failure nozzle by only generating recording image data by performing the above processing for overlapping print data and performing recording processing in accordance with the recording image data of the respective assigned print areas.

Figure 9:
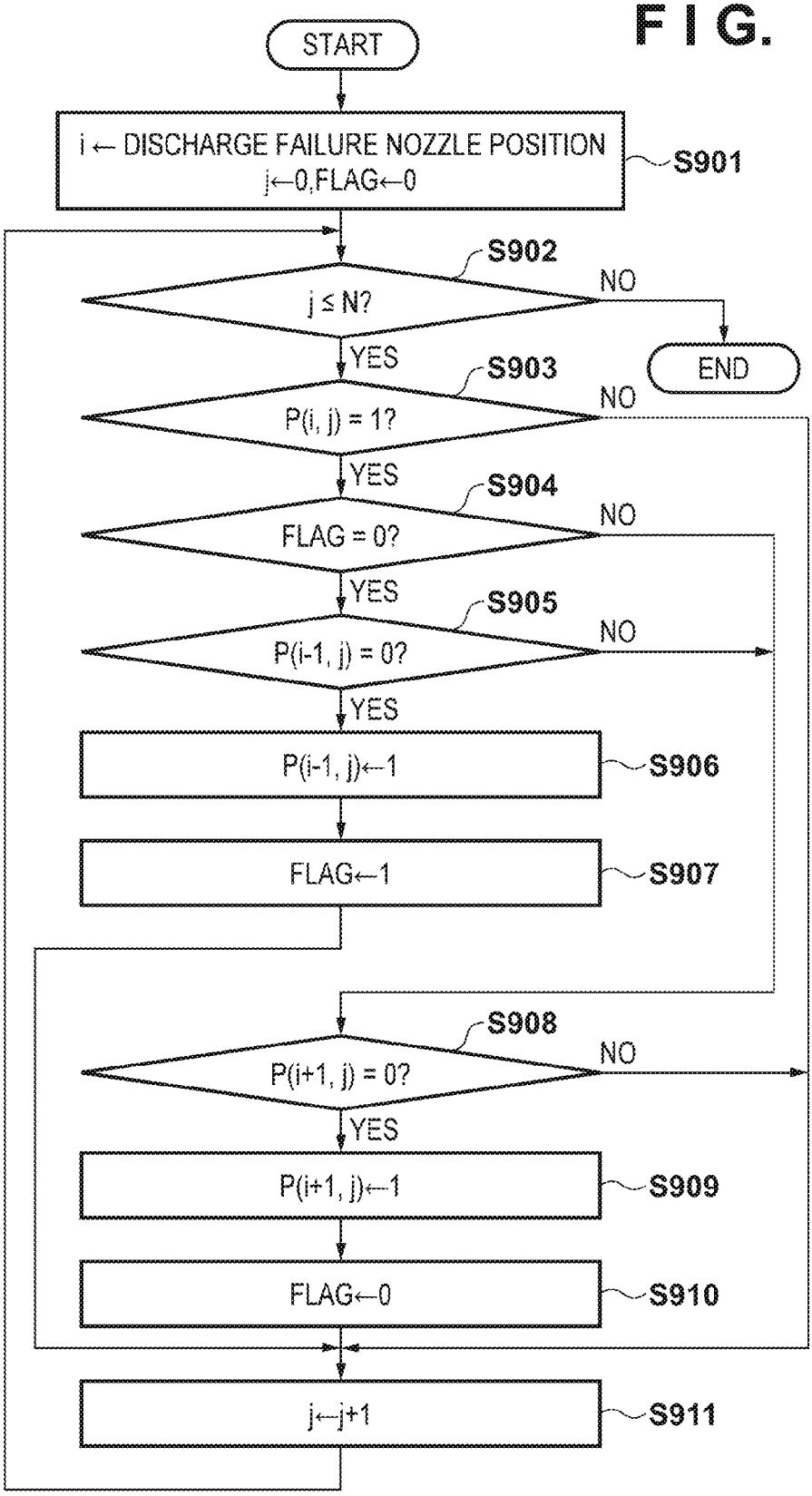
FIG. 9 is a flowchart showing discharge non-discharge nozzle complementation processing according to the first embodiment.

According to the above description, the divided data correction unit 607 performs non-discharge complementation processing by pattern matching. However, this processing may be implemented by determination processing. An example of non-discharge complementation processing by the divided data correction unit 607 in this case will be described with the flowchart of FIG. 9.

Assume that in the following description, recording image data (binary data) generated by the divided data conversion unit 606 has already been stored in the RAM 212*b*. In addition, a variable i indicates a pixel position in the horizontal direction (the x-axis direction in FIG. 1), and a variable j indicates a pixel position in the vertical direction (the y-axis direction in FIG. 1). In addition, a pixel at coordinates "i, j" in recording image data is defined as P(i, j), P(i, j)=1 represents an ink discharge pixel, and P(i, j)=0 represents a non-ink discharge pixel. Furthermore, a flag FLAG defines the moving direction of a prioritized dot; FLAG=0 indicates that a left adjacent pixel is prioritized as a movement destination, and FLAG=1 indicates that a right adjacent pixel is prioritized as a movement destination. In addition, let N be the number of lines converted by the divided data conversion unit 606 (the size of a dither matrix in the y-axis direction). Assume that these variables and flags are allocated in the RAM 212*b*.

First of all, in step S901, the divided data correction unit 607 stores the position of a discharge failure nozzle in the variable i, sets the variable j to initial value 0, and sets the flag FLAG to initial value 0. In step S902, the divided data correction unit 607 determines whether the value of the variable j is equal to or less than N. If the variable i exceeds N, the divided data correction unit 607 terminates the non-discharge complementation processing.

If the variable j is equal to or less than N, it indicates that there is an unprocessed line. The divided data correction unit 607 therefore determines in step S903 whether a target pixel P(i, j) is "1". If P(i, j)=0, since the target pixel is a non-ink discharge pixel, the variable j is incremented by "1" in step S911, and the process returns to step S902.

In addition, if P(i, j)=1, the process advances to step S904, in which the divided data correction unit 607 determines whether the flag FLAG is 0. If FLAG=0, since the left adjacent pixel of the target pixel is preferentially set as a movement destination, the divided data correction unit 607 determines in step S905 whether a left adjacent pixel P(i−1, j) is "0" (non-ink discharge pixel). If P(i−1, j)=0, the divided data correction unit 607 changes the left adjacent P(i−1, j) of the target pixel to "1" in step S906. The divided data correction unit 607 then sets the flag FLAG to "1" to set the next movement destination pixel to the right adjacent pixel (step S907). The divided data correction unit 607 causes the process to advance to step S911.

Upon determining NO in step S904 or S905, the divided data correction unit 607 causes the process to advance to step S908. In step S908, the divided data correction unit 607 determines whether a right adjacent pixel P(i+1, j) of the target pixel is "0" (non-ink discharge pixel). If P(i+1, j)=0, the divided data conversion unit 606 changes the right adjacent P(i+1, j) of the target pixel to "1" in step S909. The divided data correction unit 607 then sets the flag FLAG to "0" to set the next movement destination pixel to the left adjacent pixel (step S910). The divided data correction unit 607 causes the process to advance to step S911.

According to the above description, the divided data correction unit 607 of the ASIC 301*b* performs the above processing. However, the divided data correction unit 613 of the ASIC 301*c* also performs the same processing. This can produce the same effect as that produced by pattern matching. In addition, it is possible to suppress the consumed amount of memory as compared with pattern matching because of unnecessity to store/hold patterns to be compared.

In the above embodiment, if there is a discharge failure nozzle, non-discharge complementation is performed by using nozzles adjacent to the discharge failure nozzle. If, however, there is another nozzle of the same color in the conveying direction of a recording medium, non-discharge complementation may be performed by using the nozzle. This allows another nozzle to land ink at positions where ink should have been landed by the non-discharge nozzle, and hence can further reduce image quality deterioration such as white streaking as well as maintaining tonality as compared with non-discharge complementation using adjacent nozzles. When, in particular, a discharge failure nozzle is a nozzle which discharges a K ink, non-discharge complementation may be performed by using nozzles located in the paper feed direction and designed to discharge C, M, and Y inks. This can increase the coverage of ink on a sheet and reduce image quality deterioration such as white streaking as compared with non-discharge complementation using adjacent nozzles.

FIG. 8B shows the transition of print data at recording head joint portions when performing non-discharge complementation processing. The following will describe differences from the non-discharge complementation processing at the recording head middle portion in FIG. 8A. FIG. 8A shows an example of one recording head with the nozzles arrayed in a line along the x-axis. In contrast to this, FIG. 8B shows an example of one recording head with two nozzle arrays 811 and 812 provided at a predetermined distance in the y-axis direction and part (corresponding to four nozzles in FIG. 8B) of each nozzle array overlapping, as a "joint portion", the other. Assume that ASIC 301*b* generates recording image data to be recorded by the nozzle array 811, and the ASIC 301*c* generates recording image data to be recorded by the nozzle array 812.

In this embodiment, recording is implemented by joining the joint portions of the recording head with a gradation mask. In this case, the gradation mask is designed to reduce pixels to which ink is to be discharged toward the right side on the joint portion of the nozzle array 811. In addition, the gradation mask is designed reduce pixels to which ink is to be discharged toward the left side on the joint portion of the nozzle array 812. Shifting stepwise ink discharge pixels on the joint portion of each nozzle array to the adjacent recording head in this manner can suppress image quality deterioration such as white streaking caused by the density difference between the recording heads.

The image recording ASICs 301*b* and 301*c* perform quantization on the joint portions by using the same algorithm. Therefore, the image recording ASIC 301*b* knows what kind of quantization result is to be generated on the joint portion of the image recording ASIC 301*c*. On the contrary, the image recording ASIC 301*c* knows what kind of quantization result is to be generated on the joint portion of the image recording ASIC 301*b*. Assume that a nozzle 813 of the nozzle array 811 is a discharge failure nozzle. Since the image recording ASICs 301*b* and 301*c* exchange information, the ASIC 301*c* which performs processing on the nozzle array 812 knows that the nozzle array 811 includes the discharge failure nozzle 813.

The image recording ASIC 301*b* therefore knows that a frame 816 in the quantization result is a recording target for the discharge failure nozzle 813, but is not recorded in practice. The image recording ASIC 301*b* therefore erases the data in the frame 816. The image recording ASIC 301*c* can know the specific positions of ink discharge dots in the frame 816 in the data after quantization by the image recording ASIC 301*b*. The image recording ASIC 301*c* therefore sets the corresponding dot positions in a frame 817 to be recorded by an alternate nozzle controlled by itself as ink discharge dots. This implements processing equivalent to moving the ink discharge dots in the frame 816 to the corresponding positions in the frame 817.

Subsequently, the image recording ASICs 301*b* and 301*c* perform recording processing in accordance with the quantized data after the correction to obtain a result 819 in FIG. 8B.

As described above, according to this embodiment, the ASICs 301*b* and 301*c* share information indicating the presence/absence and position of a discharge failure nozzle by communication and generate recording image data from the print data of an overlapping area. This makes it possible to eliminate or reduce tonality deterioration regardless of the position of a discharge failure nozzle.

Note that in the above embodiment, print data transmitted by the host PC 200 to the printer 100 is sRGB multi-valued image data. However, the format of print data is not limited to this. For example, encoded image data may be used. In this case, the controller ASIC 301*a* decodes the encoded data, divides the multi-valued image data obtained by decoding, and distributes the resultant data to the ASICs 301*b* and 301*c*. Although there is no limitation in terms of format type, JPEG is a representative format.

In addition, print data may be data written in the page description language (vector-format data). When using this format, the controller ASIC 301*a* may draw image data in the RGB format based on print data in the RAM 212*a*, divide the drawn data in the same manner as described in the above embodiment, and distribute the resultant data to the ASICs 301*b* and 301*c*.

Figure 5A:
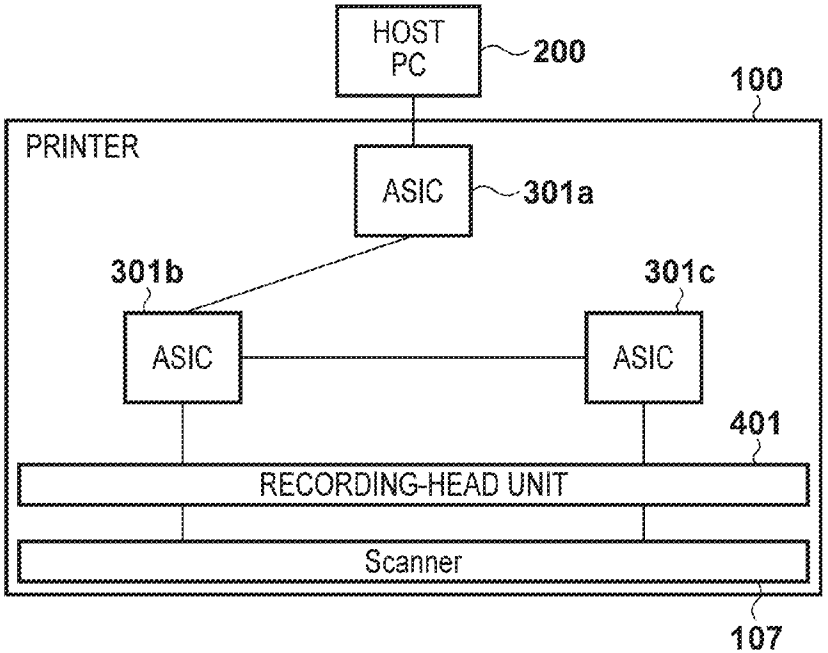
FIGS. 5A and 5B are block diagrams showing the types of parallelization of printer control circuits according to the embodiment.

Furthermore, in the above embodiment, the controller ASIC 301*a* divides print data and distributes the resultant data to the two ASICs 301*b* and 301*c*. However, as shown in FIG. 5A, the ASICs 301*a* to 301*c* may be daisy-chained to each other. In this case, the ASIC 301*a* transfers print data to the ASIC 301*b* located immediately below. The ASIC 301*b* acquires data to be processed by itself from the print data, and transfers print data other than the target data to the ASIC 301*c* located below. Using such a form eliminates the necessity to increase the number of I/Fs for a controller ASIC even if a large number of image processing ASICs are required with an increase in the width of a recording head. This makes it possible to achieve a reduction in cost.

Figure 5B:
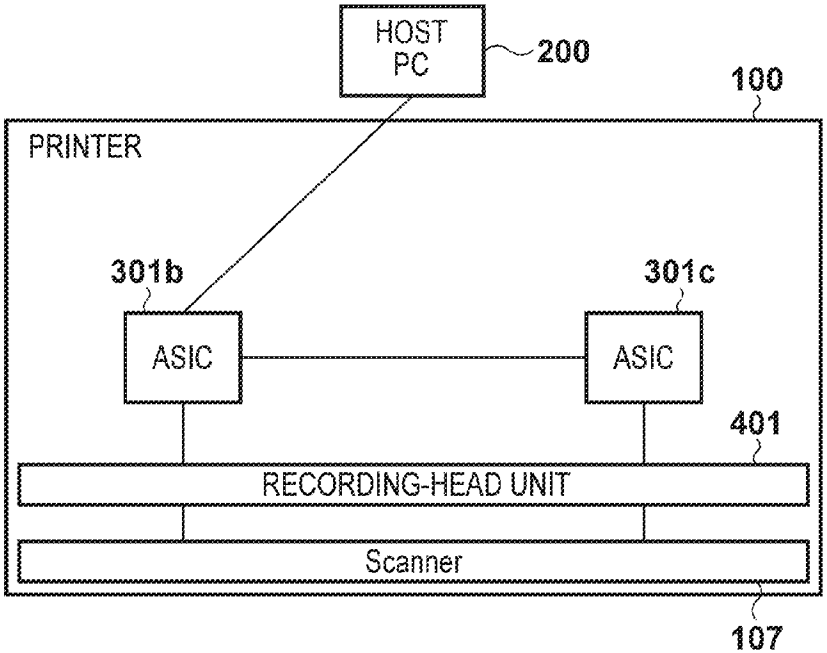

Assume that the specifications of a printer do not support printing of vector data, that is, a host PC is designed to transmit multi-value image data. In this case, since no image conversion or correction processing is performed, the load on a controller ASIC is light accordingly. It is therefore possible to use an arrangement like that shown in FIG. 5B. That is, one ASIC is made to function both as a controller ASIC and as an image processing ASIC. This eliminates the necessity to use an ASIC specialized as a controller, and hence can achieve a reduction in cost.

Figure 12:
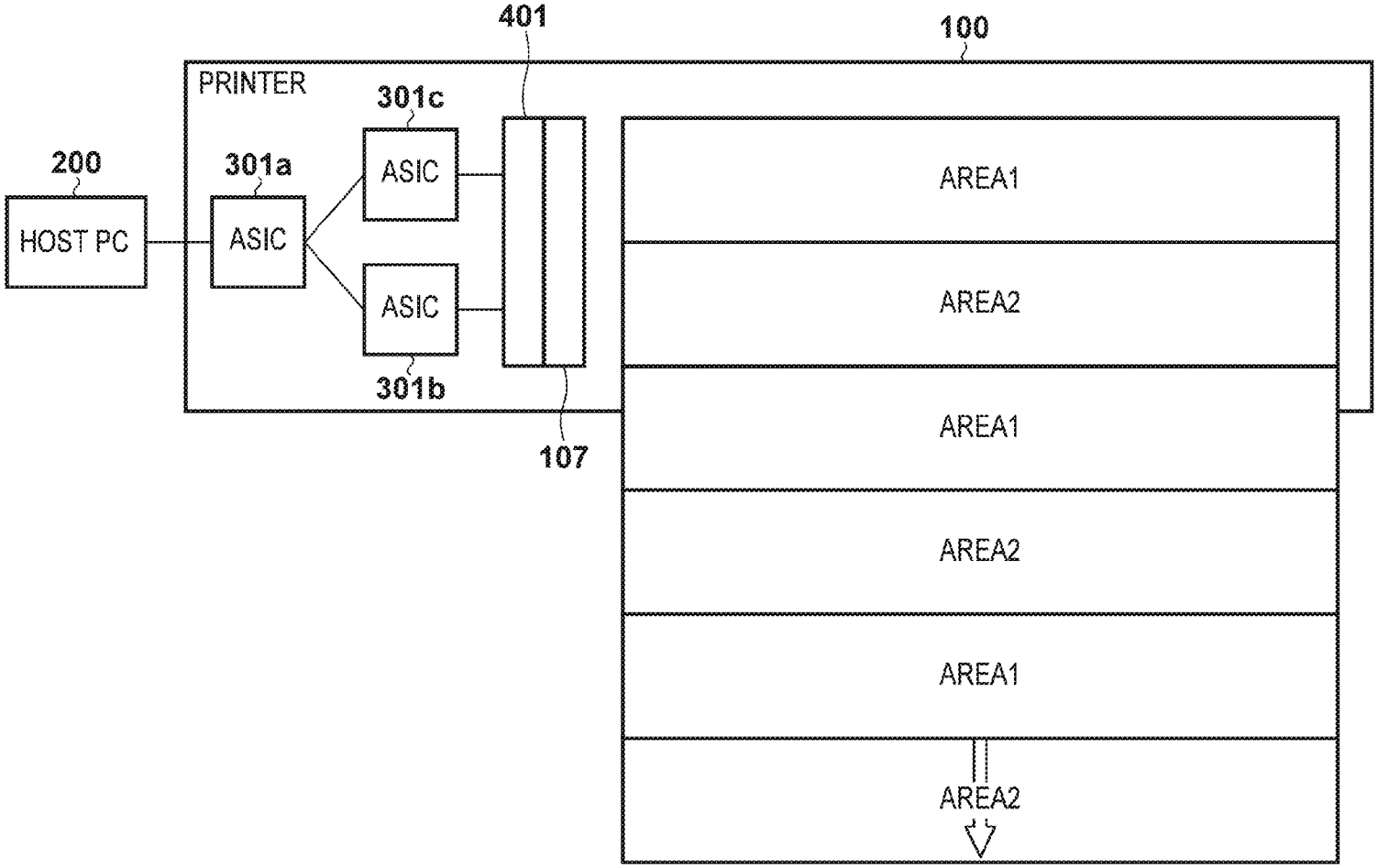
FIG. 12 is a block diagram showing a parallelization system in a serial printer according to the embodiment.

As shown in FIG. 1, the printer 100 according to this embodiment has been described as a full-line type recording apparatus. However, the present invention is not limited to this. For example, as shown in FIG. 12, the present invention can also be applied to a so-called serial type recording apparatus which performs recording by scanning a recording head or scanner in a direction intersecting with the conveying direction of a recording medium. In this case, recording processing concerning one scanning motion of a recording head is the same as that in FIG. 1 showing the arrangement configured to move the recording head relatively to a recording medium, and hence a description of the processing is not necessary. In addition, this embodiment uses an example of providing a recording head for each ink color. However, it is possible to use a form configured to cause one recording head to discharge inks of a plurality of colors. Furthermore, it is possible to use a form having nozzle arrays corresponding to inks of a plurality of colors arrayed on one discharge board.

In addition, the arrangement configured to perform image processing has been described as an ASIC in this embodiment. However, this arrangement is not necessarily limited to an ASIC as long as each arrangement is a processing unit capable of performing parallel processing.

Note that each variation of the embodiment described above can also be applied to other embodiments described below.

Second Embodiment

The second embodiment will be described below. The constituent elements of an apparatus according to this embodiment are the same as those in the first embodiment, and a description of them will be omitted. Differences from the first embodiment reside in processing by divided data conversion units 606 and 612 in ASICs 301*b* and 301*c* and processing by divided data correction units 607 and 613.

According to the first embodiment, if recording image data after quantization (binarization) includes ink discharge dots to be recorded by a discharge failure noise, adjacent non-ink discharge dots are changed to discharge dots. In contrast to this, the second embodiment implements this operation by head shading processing before binarization. Divided data correction units 607 and 612 perform this head shading processing.

As in the first embodiment, a recording characteristic detection unit 603 of the ASIC 301*b* detects the amounts of ink from the respective nozzles of the respective recording heads by making a scanner 107 read recording processing on test patterns. Detected state information is stored in a RAM 212*b* and is also notified to an ASIC 301*c* via a communication unit 604. State information received from the ASIC 301*c* via the communication unit 604 is also stored in the RAM 212*b*. The ASIC 301*c* also performs the same processing as that described above, and the respective ASICs share information concerning the amounts of ink discharged.

Note that the timing of the communication of information concerning the amounts of ink discharged is not the timing of general print processing but is the timing at which the user issues an instruction to record a test pattern with an operation unit (not shown). In addition, in order to hold the information unless new information is detected, the obtained information may be stored in a nonvolatile memory or the like.

Figure 14:
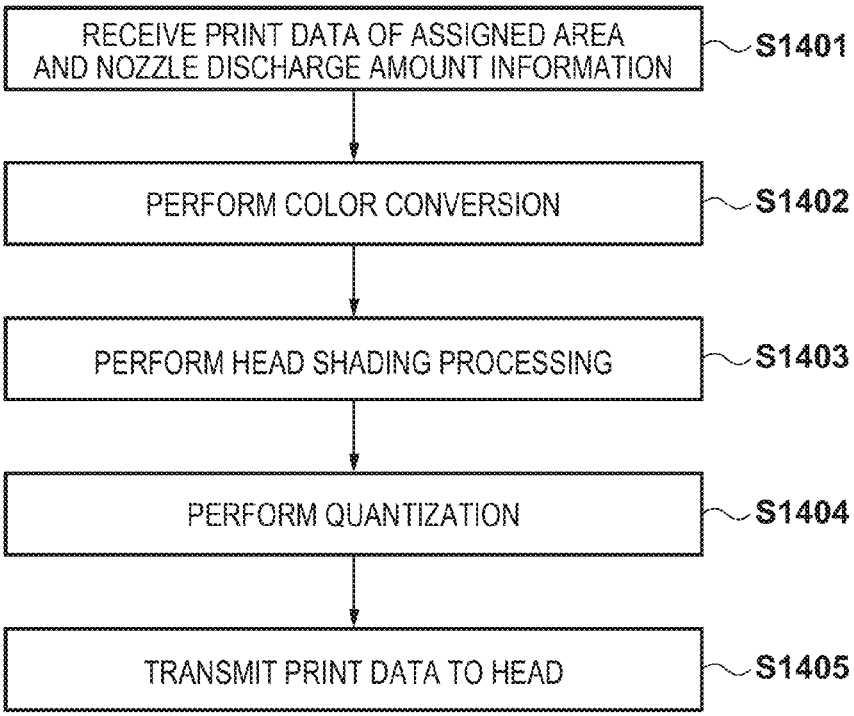
FIG. 14 is a flowchart for head shading processing in the parallelization system according to the second embodiment.

FIG. 14 is a flowchart in the ASIC 301*b* which performs head shading processing. Differences from the first embodiment will be described below. In the first embodiment, non-discharge complementation as head correction processing is performed after quantization. Head shading processing is performed after color space conversion to YMCK and before quantization.

Figure 10A:
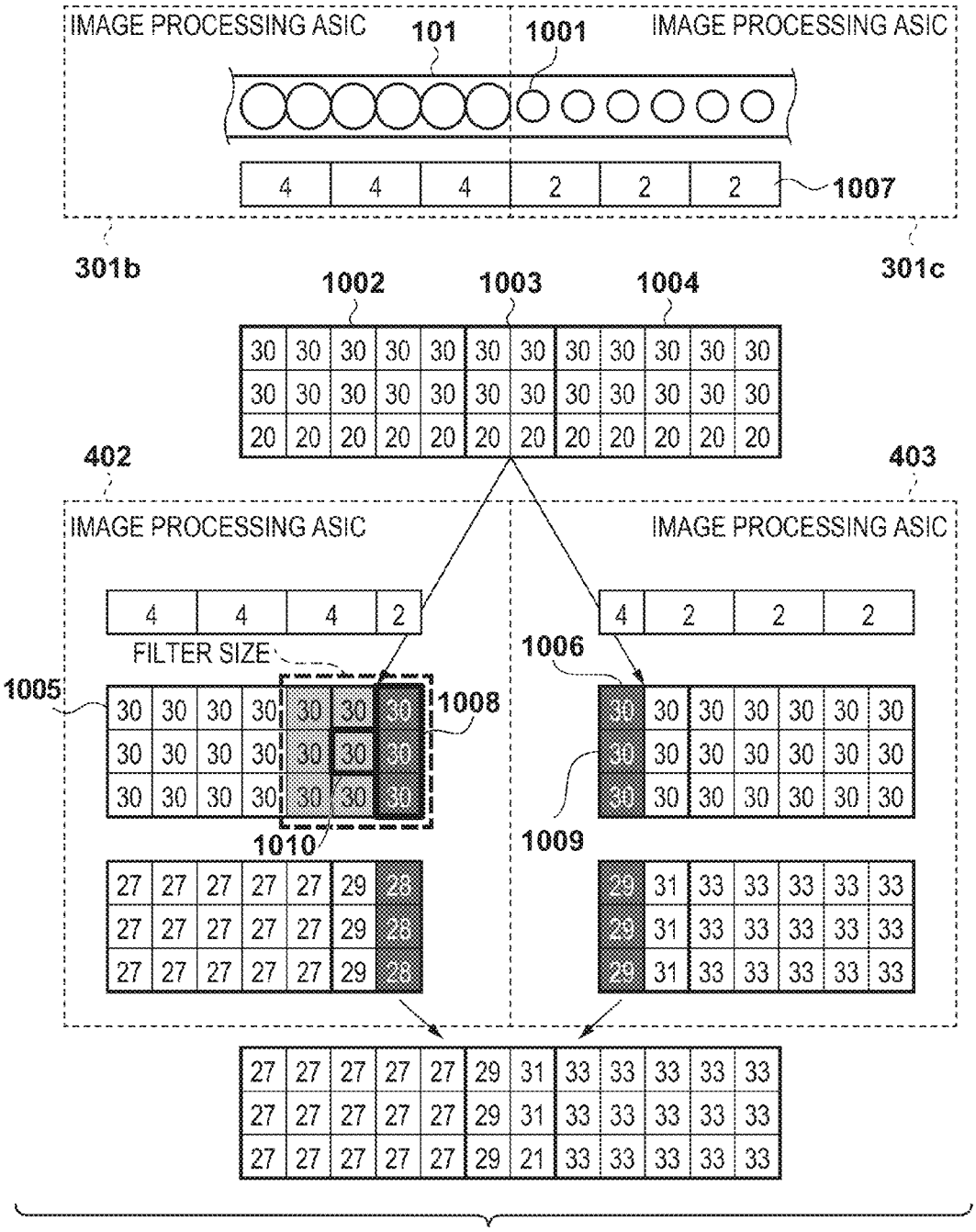
FIGS. 10A and 10B are views showing color unevenness correction in a parallelization system according to the second embodiment.

FIG. 10A shows the transition of print data when performing head shading processing in a recording head 101. The second embodiment will exemplify head shading processing in a parallelization system in a case in which the amounts of ink from the nozzles on the right side of a nozzle 1001 of the recording head 101 are small, and the amounts of ink discharged from the nozzles on the left side are large.

In addition, the nozzles controlled by the ASIC 301*c* are nozzles arranged on the right side of the nozzle 1001 and including it, and the nozzles controlled by the ASIC 301*b* are nozzles arranged on the left side of the nozzle 1001.

Referring to FIG. 10A, multi-valued data to be printed are expressed by square pixels located below the respective nozzles, and the numerical values in the squares express pixel values. The data dividing unit 602 divides the multi-valued data into three areas 1002, 1003, and 1004. A combination of the areas 1002 and 1003 is an area to be input to the ASIC 301*b*. A combination of the areas 1003 and 1004 is an area to be input to the ASIC 301*c*. The area 1002 is an area subjected to ink color conversion by the ASIC 301*b*. The area 1003 is an area subjected to ink color conversion by both the ASICs 301*b* and 301*c*. The area 1004 is an area subjected to ink color conversion by the ASIC 301*c*. The ASIC 301*b* converts the multi-valued sRGB image data of the areas 1002 and 1003 into data in the YMCK recording color space by using the divided data conversion unit 606 to generate recording multi-valued data 1005. Likewise, the ASIC 301*c* generates recording multi-valued data 1006 by converting the data of the areas 1003 and 1004 into data in the recording color space.

Head shading processing for the area data 1005 after conversion to the recording color space, which is performed by the ASIC 301*b*, will be described next. The divided data correction unit 607 performs head shading processing. The ASIC 301*b* knows the amounts of ink discharged from the respective nozzles of the recording head from state information 1007 received from the recording characteristic detection unit 603 and the ASIC 301*c*. The ASIC 301*b* performs head shading by performing filter processing for the area data 1005. Performing filter processing can reduce image quality deterioration such as color unevenness even in a recording head in which the amounts of ink discharged from the nozzles abruptly change. In this case, an area 1008 which is not printed is used as a marginal portion of filter processing. The ASIC 301*c* performs similar processing. In head shading processing, an area 1009 which is not printed is used as a marginal portion.

The divided data conversion unit 606 generates quantized recording image data from the print data having undergone the head shading processing. Subsequently, a recording head control unit 608 controls the recording head in accordance with the recording image data for recording with the nozzles controlled by the ASIC 301*b*. In the case of the ASIC 301*b*, recording print data sent to the recording head is data excluding an area corresponding to one pixel on the right end. On the other hand, the ASIC 301*c* performs recording processing by using recording image data excluding an area corresponding one pixel on the left end.

A preferred example of a head shading method for the recording head according to the second embodiment will be described. Referring to FIG. 10A, the nozzle discharge amount information 1007 is generated based on recording of test patterns and detection results obtained by the scanner 107. The nozzle discharge amount information 1007 is expressed by discharge amount ranks. Discharge amount ranks classify the detected amounts of ink discharged, and are ranks set in accordance with the predetermined ranges of the amounts of ink discharged. In the second embodiment, five ranks are set. Lower ranks indicate smaller amounts of ink discharged, and vice versa. A reference rank is 3. A simple method of deciding the widths of the respective ranks is to equally divide the difference between the minimum and maximum amounts of ink which can be discharged from the printer into five amounts. Another method may decide the widths of the ranks from sigma values within the amplitude of the amount of ink discharged. The number of ranks is not limited to five, and may be increased/decreased in accordance with the correction accuracy of head shading processing. In this embodiment, rank 3 is set as a center value, and head shading processing is performed to match with the amount of ink discharged at rank 3. Filter processing is performed upon deciding a filter intensity in accordance with the ranks of a target pixel and peripheral pixels. Processing for a pixel 1010 as a target pixel will be described below. A filter coefficient is decided in accordance with a rank value. For example, a coefficient corresponding to rank 2 is 1.1, a coefficient corresponding to rank 3 is 1.0, and a coefficient corresponding to rank 4 is 0.9. A filter for head shading for the pixel 1010 is the following 3×3 size filter:

0.9 0.9 1.1
0.9 0.9 1.1
0.9 0.9 1.1

Head shading is performed by performing filter processing while deciding a filter intensity in the above manner.

Note that in the above description, the filter size is 3×3. However, this is not exhaustive. An abrupt change in amount of ink discharged can be effectively absorbed by using a wider filter such as a 5×5 or 7×7 filter. In addition, according to this embodiment, a filter intensity is decided uniquely from a discharge amount rank. However, a filter intensity may be obtained by multiplying a coefficient decided from a discharge amount rank by a coefficient which increases toward the center as in the case of a Gaussian filter. This can minimize the bluntness of an edge portion of an image. Alternatively, a coefficient may be changed in accordance with the value of an ink color density. For example, when an ink color density value of 0 expresses a white point in an image, changing the density color may color each white point, resulting in image quality deterioration. If it is possible to change a filter coefficient in accordance with an ink density value, an optimal filter coefficient can be set in accordance with an ink density value. This can reduce image quality deterioration. As a method of deciding a filter coefficient in accordance with an ink density value, a formula may be used for calculation or a 1D-LUT may be used for calculation.

According to the above description, in the recording head, an area where ink color conversion is redundantly performed at the boundary of areas assigned to the ASICs 301*b* and 301*c* is set, and the nozzle discharge amount information 1007 is transmitted. This makes it possible to perform head shading processing even when different ASICs control a recording head, thus reducing image quality deterioration.

The second embodiment has exemplified the case in which head shading processing using areas assigned to both the ASICs 301*b* and 301*c* can be performed by making them process an area in a range at the boundary between the areas assigned to the ASICs. An effect similar to that of the second embodiment can be obtained by another implementation method, that is, transmitting ink value increase/decrease information to ASICs in charge of adjacent areas.

Figure 10B:
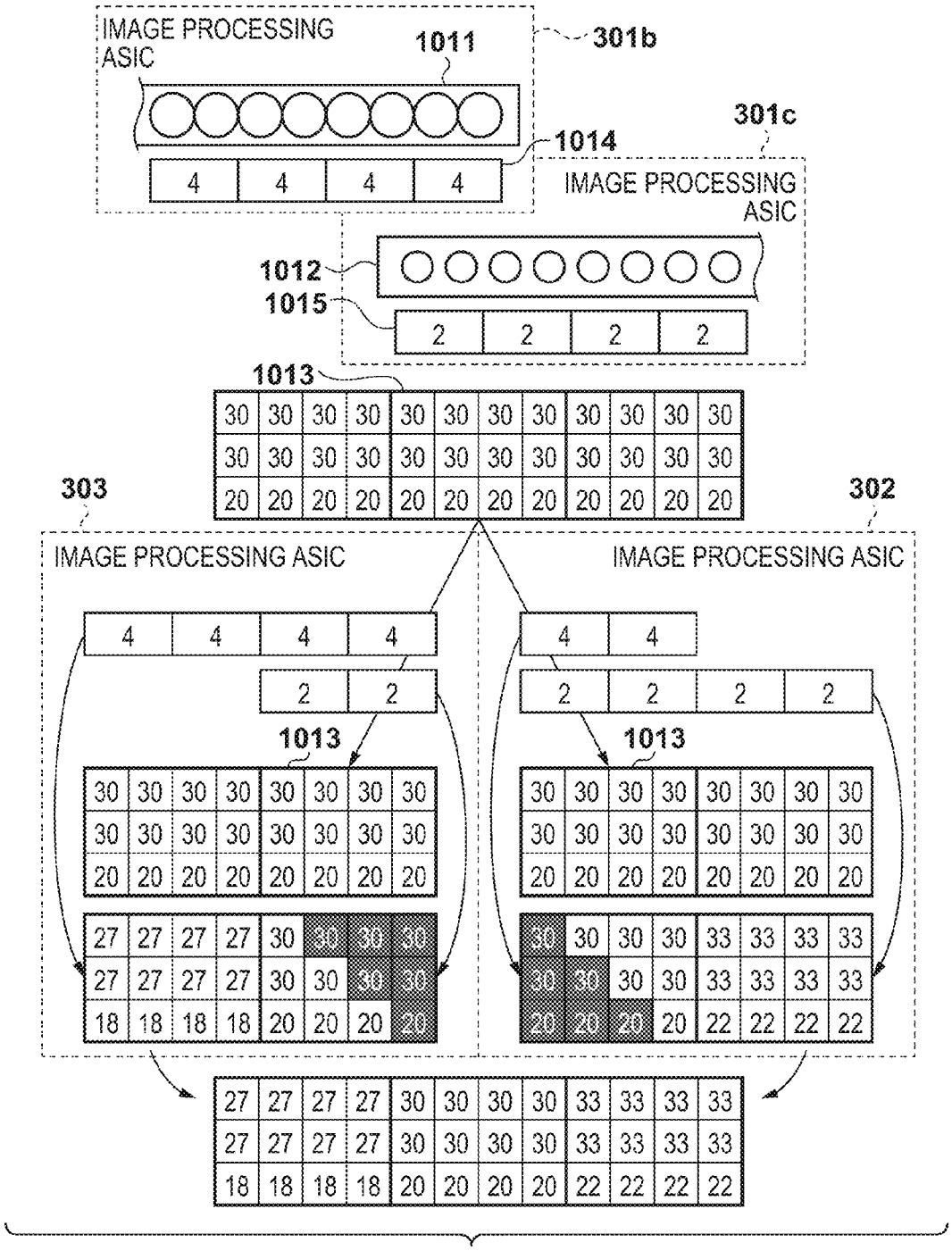

As shown in FIG. 10B, one recording head is constituted by two nozzle arrays 1011 and 1012, and the arrays overlap in a recording head joint portion (corresponding to four nozzles in FIG. 10B). Non-discharge complementation processing in this case will be described below. Note that the nozzle array 1011 corresponds to the ASIC 301*b*, and the nozzle array 1012 corresponds to the ASIC 301*c*. In this embodiment, as in the first embodiment, the joint portions of the recording head are joined with a gradation mask to implement printing.

Head shading processing will be described in a case in which an ASIC 302 controls the nozzle array 1011 and an ASIC 303 controls the nozzle array 1012, as shown in FIG. 10B. In the case shown in FIG. 10B, as in the case shown in FIG. 10A, both the ASICs perform head shading processing based on an overlapping area 1013 in recording multi-valued data after ink color conversion. In the joint portions of the recording head, discharge amount information 1014 and nozzle discharge amount information 1015 exist. Assume that the ASICs 301*b* and 301*c* share these pieces of discharge amount information 1014 and 1015 by communication via the communication units of the respective ASICs.

A preferred example of head shading processing in the printing head joint portions will be described next. Discharge amount ranks are obtained from nozzle discharge amount information as in the case shown in FIG. 10A. Referring to FIG. 10B, a correction 1D-LUT is prepared in advance for each discharge amount rank, and the correction 1D-LUT is decided by a discharge amount rank. Head shading processing is performed by applying the decided correction 1D-LUT to the ink color value of each pixel. As described above, since the area 1013 includes two discharge amount ranks, a correction 1D-LUT is decided from the two discharge amount ranks. The simplest method is to obtain a correction 1D-LUT by using the average value of the two ranks.

According to the above description, in the joint portions of the recording head, the amounts of ink discharged from the nozzles of the nozzle arrays 1011 and 1012 are separately detected. However, the amount of ink discharged from one nozzle may be detected while the joint portions of the recording head are joined with a gradation mask. Transmitting the detected amounts of ink discharged to both the ASICs 301*b* and 301*c* can obtain the same effect as that in the first embodiment.

The second embodiment has exemplified the case in which an area where ink color conversion is redundantly performed is set at the boundary between the areas assigned to the ASICs 301*b* and 301*c*, and the discharge amount information 1014 and the nozzle discharge amount information 1015 are communicated. With this operation, even if different ASICs control the recording head, head shading processing can be performed. This can reduce image quality deterioration.

In the second embodiment, the divided data correction unit 613 performs head shading processing for divided data after ink color conversion. However, head shading processing may be performed for divided data before ink color conversion. Referring to FIG. 10A, a filter coefficient is calculated by using a 3D-LUT or formula. Referring to FIG. 10B, a correction 3D-LUT is obtained from discharge amount ranks. Performing head shading processing before ink color conversion can perform shading processing even for a color constituted by two or more types of inks. This can reduce image quality deterioration such as color unevenness.

Third Embodiment

Figure 11A:
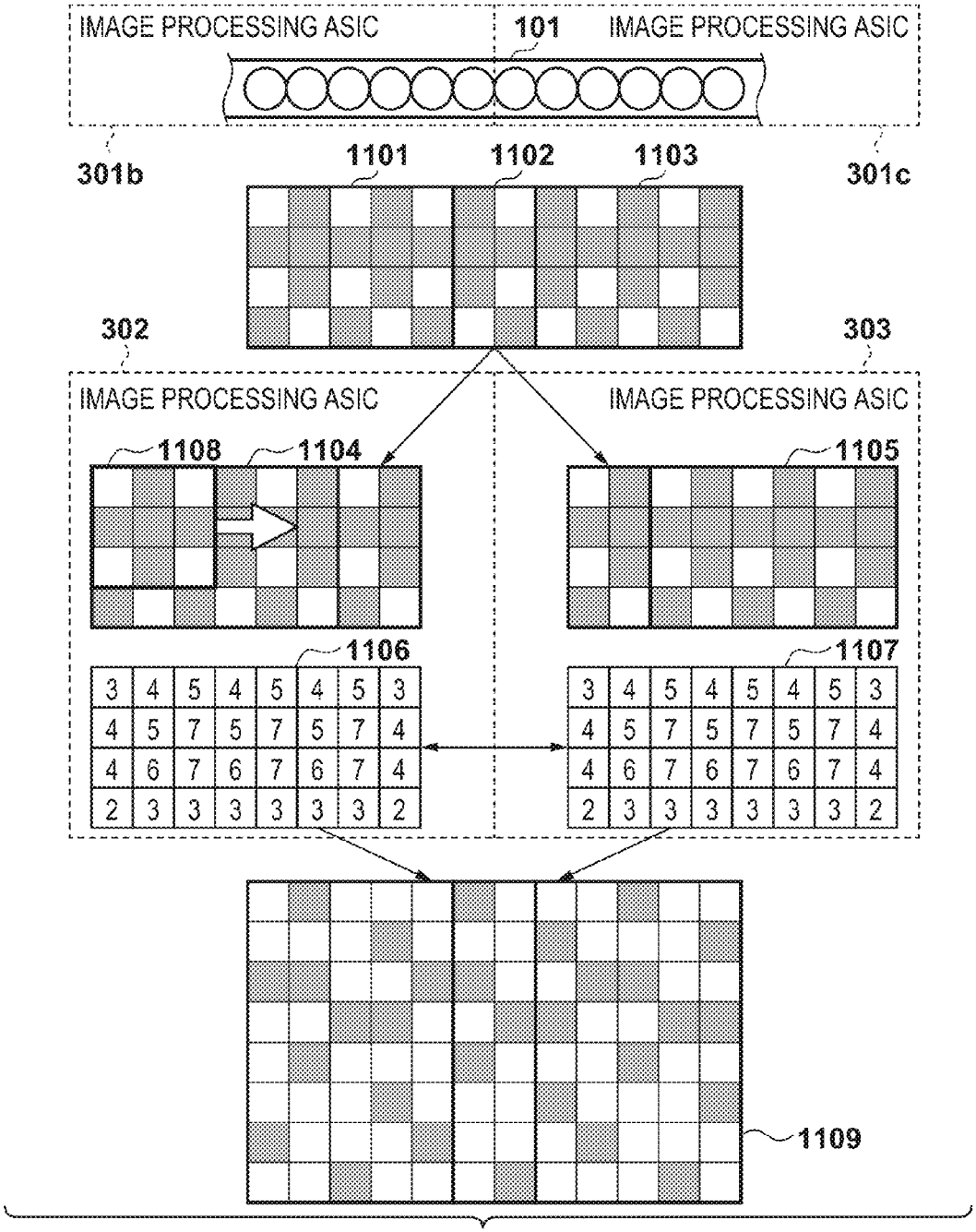
FIGS. 11A and 11B are views showing an example of monitor control in a parallelization system according to the third embodiment.
Figure 11B:
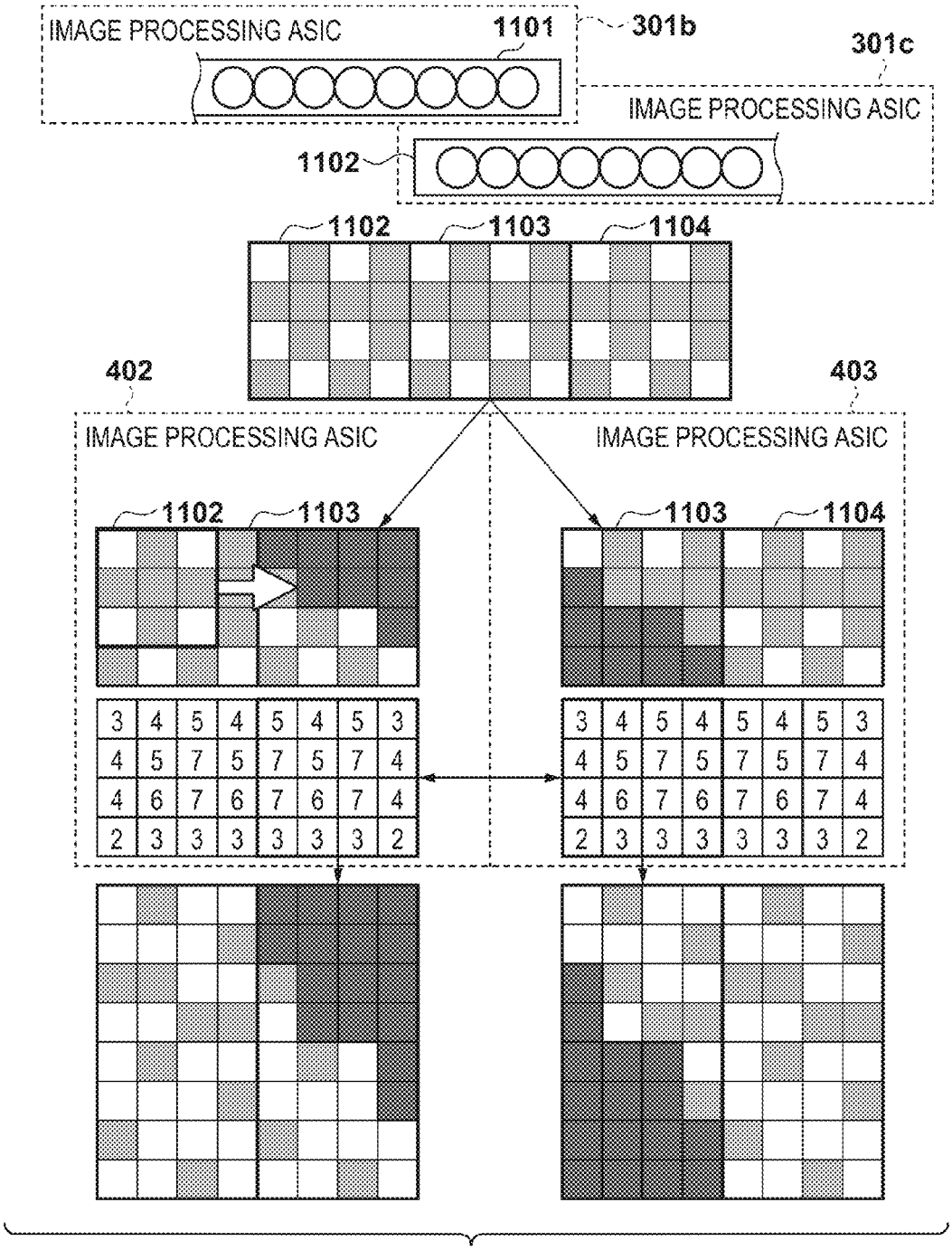

FIGS. 11A and 11B are views showing an example of monitor control in a parallelization system according to the third embodiment of the present invention. Monitor control described below is one type of correction processing performed by divided data correction units 607 and 613 in the respective ASICs.

A preferred example of processing will be described in detail below. A recording characteristic detection unit 603 of an ASIC 301*b* generates dot count information by counting the number of dots to be discharged by using a dot count filter 1108 with respect to four-line (depending on the size of a dither matrix for quantization processing) recording image data after quantization stored in a RAM 212*b*. That is, the value of data to be driven within the filter matrix is counted every time the matrix is moved by one pixel. This dot count information is transmitted to an ASIC 301*c* via the communication unit 604.

A recording characteristic detection unit 609 of the ASIC 301*c* also generates dot count information in the same manner, and transmits the information to the ASIC 301*b* via a communication unit 610. As a result, the ASICs 301*b* and 301*c* share the dot count information. As described above, since the timing of the communication of dot count information is after the quantization of print data, the communication is performed during printing.

Figure 15:
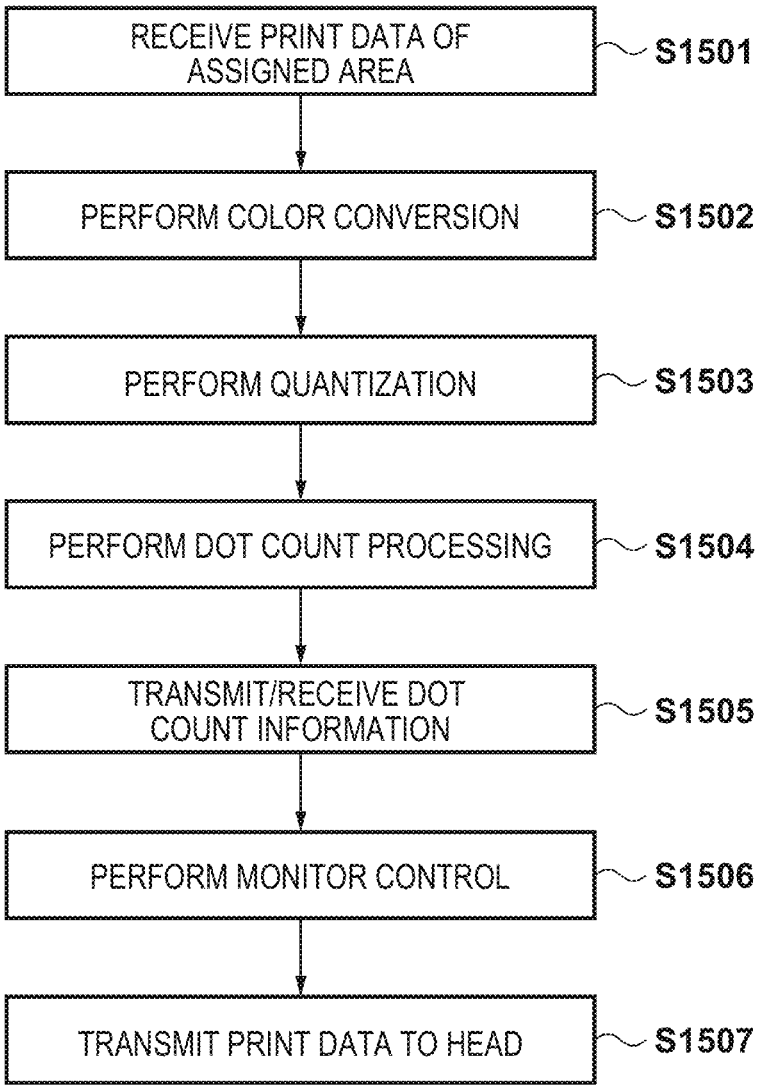
FIG. 15 is a flowchart for monitor control in the parallelization system according to the third embodiment.

FIG. 15 is a flowchart in the ASIC 301*b* which performs monitor control. Steps S1501 and S1502 correspond to steps S1301 and S1302 in FIG. 13. Therefore, differences from the first embodiment will be described below. In the first embodiment, discharge failure nozzle information is received before the quantization of print data. In monitor control in the third embodiment, dot count information is calculated by dot count processing (counting processing) performed after the quantization of print data. For this reason, after quantization in step S1503, dot count processing is performed in step S1504. Thereafter, dot count information is communicated in step S1505. In step S1506, monitor control is performed. In step S1507, the ASIC 301*b* performs transfer processing of print data to the recording head unit.

FIG. 11A shows the transition of recording image data in a recording head 101 when performing dot count control. Referring to FIG. 11A, recording image data are expressed by square pixels located below the respective nozzles. Each white square expresses a pixel to which no ink is discharged. Each gray square expresses a pixel to which ink is discharged. A print data dividing unit 602 divides the data into three areas 1101, 1102, and 1103. A combination of the areas 1101 and 1102 is an area to be input to the ASIC 301*b*. A combination of the areas 1102 and 1103 is an area to be input to the ASIC 301*c*. The area 1101 is an area to be quantized by the ASIC 301*b*. The area 1102 is an area to be quantized by both the ASICs 301*b* and 301*c*. The area 1103 is an area to be quantized by the ASIC 301*c*. The ASIC 301*b* converts the sRGB multi-valued image data of the input areas 1101 and 1102 into data in the YMCK recording color space by using a divided data conversion unit 606, and further quantizes the data, thereby generating the recording image data of an area 1104. Likewise, the ASIC 301*c* generates recording image data 1105 from the area 1102 and the area 1103.

Dot count processing with respect to the area 1104 after quantization, which is performed by the ASIC 301*b*, will be described next. Dots are counted from quantized print data by using the dot count filter 1108 with a size of, for example, 3×3. All the filter coefficients of the dot count filter are 1. Performing filter processing can generate dot count information 1106. All generated dot count information is transmitted to the ASIC 301*c* via the communication unit 604. Likewise, the ASIC 301*c* also generates dot count information 1107 from print data after quantization, and transmits the information to the ASIC 301*b* via the communication unit 610. With this operation, the ASICs 301*b* and 301*c* can share the dot count information of all the areas recorded by the recording head 101. In dot count control, the ASIC 301*b* compares a count threshold decided for each printer with the pieces of dot count information 1106 and 1107. If there is at least one pixel whose count information exceeds the count threshold, the printing speed is decreased. As the number of dots simultaneously discharged increases, ink cannot be stably discharged, resulting in image quality deterioration such as white streaking and color unevenness. Decreasing the printing speed based on dot count information can reduce the number of dots to be simultaneously discharged, thereby stably discharging ink. This can reduce image quality deterioration such as white streaking and color unevenness.

As a preferred example, therefore, an ASIC 302 and an ASIC 303 need to obtain the same quantization result on the area 1102. This is merely a preferred example, and the obtained quantization results need not perfectly match each other. The present invention can be applied to a case in which quantization results differ from each other within the range in which no image quality deterioration occurs after non-discharge complementation. For example, when dot counts are compared with each other within a predetermined range, the present invention can be applied if the difference falls within a predetermined range.

Printing speeds include a normal speed mode and a low speed mode. In the low speed mode, the number of times of ink discharge from each nozzle per unit time is smaller than that in the normal speed mode. Simply put, the time intervals (or the driving cycle) at which nozzles are continuously driven in the normal speed mode is doubled in the low speed mode. Note however that the conveying speed of a recording medium in the low speed mode is ½ that in the normal speed mode. A simple method of doubling the recording time intervals of nozzles can be implemented by inserting blank dots in the conveying direction as indicated by reference numeral 1109 in FIG. 11A.

Note that when recording is to be performed at a speed 1/N the normal speed, the driving time intervals of nozzles may be multiplied by N, and the conveying speed of a recording medium may be multiplied by 1/N.

As a result of the above operation, according to the third embodiment, in the recording head, an area to be redundantly quantified is set at the boundary between areas assigned to the ASICs 301*b* and 301*c*, and discharge failure nozzle information is communicated. This can perform non-discharge complementation processing between different ASICs and reduce image quality deterioration.

In the third embodiment, all dot count information is communicated. However, comparing a count value obtained at the time of dot counting with a count threshold can implement the same operation by transmitting only the comparison result to an ASIC in charge of an adjacent area. Transmitting only the comparison result can reduce the communication volume of dot count information and hence can speed up the processing.

In the third embodiment, all dot count information is communicated to image processing ASICs. However, such information may be transmitted to only the ASIC 301*a*. In this case, the controller ASIC may compare the dot count information with the count threshold to determine whether to decrease the printing speed, and notify the image processing ASICs of the determination result. This can reduce the processing loads on the image processing ASICs and prevent a decrease in processing speed.

FIG. 11B shows the transition of print data on the recording head joint portions when performing dot count control. The effect of the present invention can be obtained by the same method as that described with reference to FIG. 11A.

In this embodiment, on the recording head joint portions, an area to be redundantly quantified is set at the boundary between the areas assigned to the ASIC 302 and the ASIC 303, and dot count information is communicated. This can perform dot count control between different ASICs and reduce image quality deterioration.

Fourth Embodiment

Figure 16:
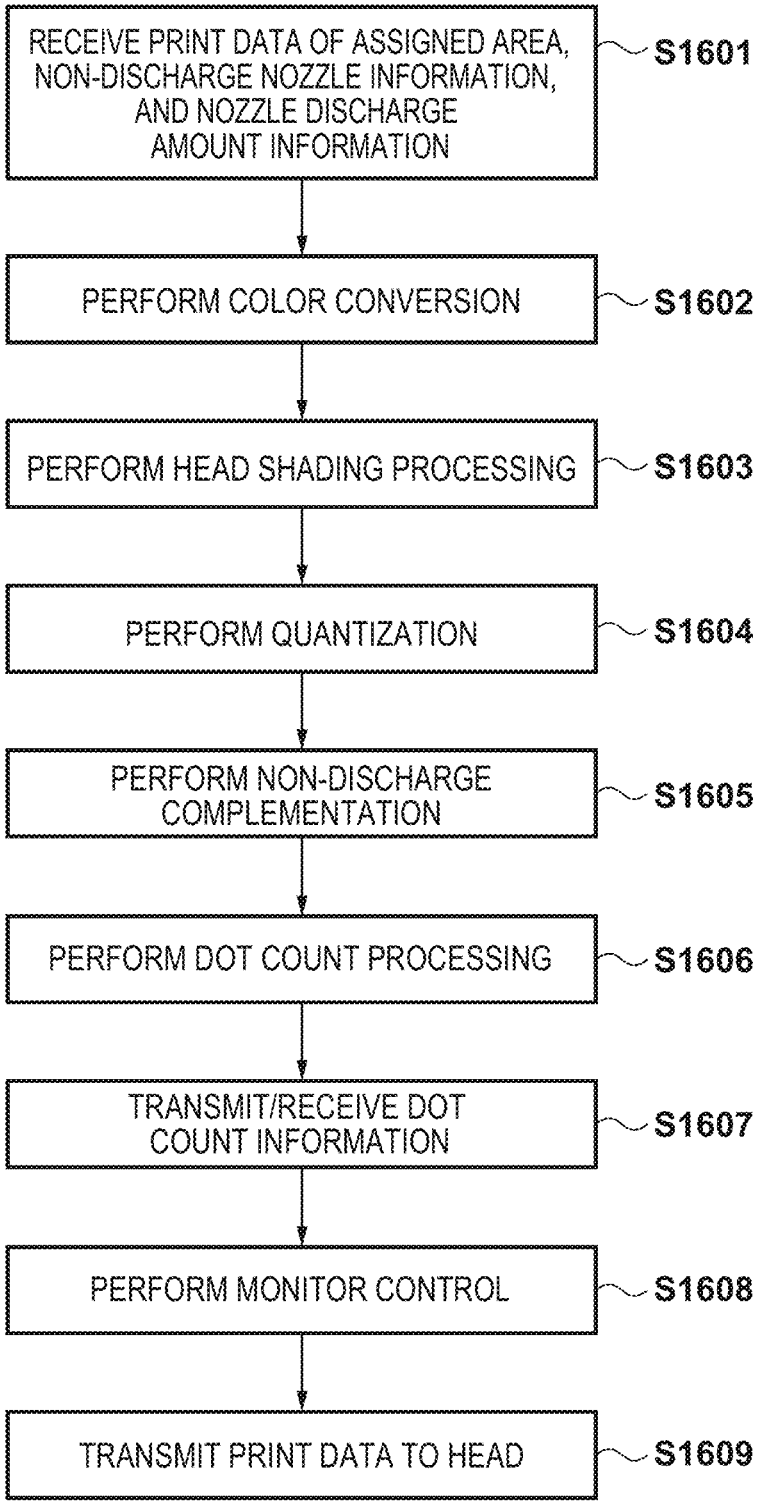
FIG. 16 is a flowchart for composite processing in a parallelization system according to the fourth embodiment.

The first to third embodiments may be simultaneously executed. FIG. 16 is a flowchart for the simultaneous execution of non-discharge complementation processing, head shading processing, and monitor control. Differences from the first to third embodiments will be described below. Although the following will describe processing by an ASIC 301*b*, the same applies to an ASIC 301*c*.

In step S1601, the ASIC 301*b* receives the print data (sRGB multi-valued image data) of an assigned area, discharge failure nozzle information, and nozzle discharge information. The print data of the assigned area is data divided by a data dividing unit 602. A dividing method used when performing a plurality of types of correction processing matches the area of a margin 701 with correction processing, of the respective types of correction processing, which uses the largest margin. For example, if margins for non-discharge complementation, head shading, and monitor control are respectively one array, three arrays, and five arrays, the margin 701 is five arrays.

In step S1602, the ASIC 301*b* converts the input data into multi-valued data in the YMCK recording color space. In step S1603, the ASIC 301*b* performs head shading processing from ink color data and nozzle discharge amount information. In step S1604, the ASIC 301*b* quantizes the data after the head shading processing. In step S1605, the ASIC 301*b* performs non-discharge complementation from the data after the quantization and discharge failure nozzle information. In step S1606, the ASIC 301*b* performs dot count processing for the data after the non-discharge complementation. In step S1607, dot count information is communicated. In step S1608, the ASIC 301*b* performs monitor control from the received dot count information. In step S1609, the ASIC 301*b* transmits the generated print data to the recording-head unit 401 to perform printing. The divided data conversion unit 606 performs steps S1602 and S1604. The divided data correction unit 607 performs step S1603 and steps S1605 to S1609. The ASIC 301*c* also performs similar processing.

Performing correction processing in the above manner makes it possible to simultaneously execute the first to third embodiments, thereby simultaneously reducing image quality deterioration such as white streaking and color unevenness.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-081229, filed Apr. 10, 2015, which is hereby incorporated by reference herein in its entirety.

What is claimed is:

1. An image recording apparatus comprising:

a recording head configured to record an image by discharging ink onto a recording medium;

an acquisition unit configured to acquire information concerning a discharging state of ink on the recording head;

a first processing unit configured to perform processing of generating recording image data of a first area to be recorded by the recording head;

a second processing unit configured to perform processing of generating recording image data of a second area to be recorded by the recording head, the second processing unit being configured to operate concurrently with the first processing unit;

a dividing unit configured to generate, from input data, divided data corresponding to the first area and the second area and supply the divided data corresponding to the first area to the first processing unit and supply the divided data corresponding to the second area to the second processing unit, and a control unit configured to perform driving control on the recording head based on the input data, wherein each of the first processing unit and the second processing unit includes a receiving unit configured to receive information concerning the discharging state of ink on the recording head corresponding to the first area and information concerning the discharging state of ink on the recording head corresponding to the second area acquired by the acquisition unit, and a generation unit configured to generate the recording image data from the divided data based on the received information concerning the discharging state of ink on the recording head corresponding to the first area and the received information concerning the discharging state of ink on the recording head corresponding to the second area, and wherein the generation unit of the first processing unit generates the recording image data for the first area from the divided data for the first area and the generation unit of the second processing unit generates the recording image data for the second area from the divided data for the second area.

2. The apparatus according to claim 1, wherein the recording head has a structure in which a nozzle array corresponding to the first area and a nozzle array corresponding to the second area are continuously arrayed in a line.

3. The apparatus according to claim 1, wherein the recording head has a structure in which a nozzle array corresponding to the first area and a nozzle array corresponding to the second area are arranged at a predetermined distance in a direction orthogonal to an array direction of the nozzle arrays, and a preset number of nozzles are arranged so as to overlap each other in the array direction of the nozzle arrays.

4. The apparatus according to claim 1, wherein the acquisition unit acquires the information concerning a discharge failure nozzle, and wherein the control unit moves data, in the recording image data, which is assigned to the failure discharge nozzle to data of a nozzle which is adjacent to the failure discharge nozzle and configured to discharge ink.

5. The apparatus according to claim 1, wherein the acquisition unit acquires the information concerning an amount of ink discharged from each nozzle of the recording head, and wherein the generation unit includes:

a conversion unit configured to convert the input data into recording multi-valued image data;

a correction unit configured to correct the recording multi-valued image data obtained by conversion, based on an amount of ink discharged from each nozzle which is to record the multi-valued image data; and a quantization unit configured to generate the recording image data indicating whether to discharge ink, by quantizing multi-valued image data after correction.

6. The apparatus according to claim 5, wherein the correction unit classifies an amount of ink discharged from each nozzle into a preset rank, and corrects the multi-valued image data by using a filter of a matrix having a coefficient assigned to each rank.

7. The apparatus according to claim 1, further comprising:

a counting unit configured to count, within a matrix with a preset size, the number of items of data, in the recording image data, which requires ink discharge; and a decision unit configured to decide a driving cycle of each nozzle of the recording head and a relative conveying speed of a recording medium in accordance with whether the counted number exceeds a preset threshold.

8. The apparatus according to claim 1, wherein the first processing unit and the second processing unit comprise ASICs.

9. The apparatus according to claim 1, wherein the acquisition unit acquires the information specifying the position of a discharge failure nozzle, and the receiving unit of the first processing unit and the receiving unit of the second processing unit receives the information specifying the position of a discharge failure nozzle.

10. The apparatus according to claim 9, wherein the generation unit of the first processing unit generates the recording image data for an area which is in the first area and closed to boundary of the first and second areas, based on the received information indicating a discharge failure nozzle corresponding to an area which is in the second area and closed to boundary of the first and second areas.

11. The apparatus according to claim 1, wherein the acquisition unit acquires the information specifying the position of a discharge failure nozzle and information specifying a color corresponding to the discharge failure nozzle, and the receiving unit of the first processing unit and the receiving unit of the second processing unit receives the information specifying the position of a discharge failure nozzle and information specifying the color corresponding to the discharge failure nozzle.

12. The apparatus according to claim 11, wherein the acquisition unit acquires the information concerning an amount of ink discharged from a nozzle of the recording head based on a read test pattern image printed by the recording head.

13. The apparatus according to claim 1, wherein the acquisition unit acquires the information concerning an amount of ink discharged from a nozzle of the recording head, and the receiving unit of the first processing unit and the receiving unit of the second processing unit receives the information concerning an amount of ink discharged from the nozzle of the recording head.

14. The apparatus according to claim 1, wherein the generation unit of the first processing unit generates the recording image data for an area closed to boundary of the first and second areas, based on the received information for the second area.

15. A control method of controlling an image recording apparatus which comprises:

a recording head configured to record an image by discharging ink onto a recording medium;

an acquisition unit configured to acquire information concerning a discharge state of ink on the recording head;

a first processing unit configured to perform processing of generating recording image data of a first area to be recorded by the recording head;

a second processing unit configured to perform processing of generating recording image data of a second area to be recorded by the recording head, the second processing unit being configured to operate concurrently with the first processing unit;

a dividing unit configured to generate, from input data, divided data corresponding to the first area and the second area and supply the divided data corresponding to the first area to the first processing unit and supply the divided data corresponding to the second area to the second processing unit; and a control unit configured to perform driving control on the recording head based on the input data, wherein the method comprises:

causing each of the first processing unit and the second processing unit to receive information concerning the discharging state of ink on the recording head corresponding to the first area and information concerning the discharging state of ink on the recording head corresponding to the second area acquired by the acquisition unit, and to generate the recording image data from the divided data based on the received information concerning the discharging state of ink on the recording head corresponding to the first area and the received information concerning the discharging state of ink on the recording head corresponding to the second;

causing the first processing unit to generate the recording image data for the first area from the divided data for the first area; and causing the second processing unit to generate the recording image data for the second area from the divided data for the second area.

16. The method according to claim 15, wherein the recording head has a structure in which a nozzle array corresponding to the first area and a nozzle array corresponding to the second area are continuously arrayed in a line.

17. The method according to claim 15, wherein the recording head has a structure in which a nozzle array corresponding to the first area and a nozzle array corresponding to the second area are arranged at a predetermined distance in a direction orthogonal to an array direction of the nozzle arrays, and a preset number of nozzles are arranged so as to overlap each other in an array direction of the nozzle arrays.

18. The method according to claim 15, wherein the acquisition unit acquires the information concerning a failure discharge nozzle, and wherein the first processing unit and the second processing unit move data, in the recording image data, which is assigned to the failure discharge nozzle to data of a nozzle which is adjacent to the failure discharge nozzle and configured to discharge ink.

19. The method according to claim 15, wherein the acquisition unit acquires the information concerning an amount of ink discharged from each nozzle of the recording head, and wherein the first processing unit and the second processing unit:

convert the input data into recording multi-valued image data;

correct the recording multi-valued image data obtained by conversion, based on an amount of ink discharged from each nozzle which is to record the multi-valued image data; and generate the recording image data indicating whether to discharge ink, by quantizing multi-valued image data after correction.

20. An image recording apparatus comprising:

a recording head configured to record an image by discharging ink onto a recording medium;

an acquisition unit configured to acquire information concerning a discharge state of ink on the recording head;

a first processing unit configured to perform processing of generating recording image data of a first area to be recorded by the recording head;

a second processing unit configured to perform processing of generating recording image data of a second area to be recorded by the recording head, the second processing unit being configured to operate concurrently with the first processing unit;

a dividing unit configured to generate, from input data, divided data corresponding to the first area and the second area and partly overlapping each other and supply the respective divided data to the first processing unit and the second processing unit; and a control unit configured to perform driving control on the recording head based on the input data, wherein the first processing unit includes a first receiving unit configured to receive information concerning the discharging state of ink on the recording head corresponding to the first area and information concerning the discharging state of ink on the recording head corresponding to the second area acquired by the acquisition unit, and a first generation unit configured to generate the recording image data from the divided data corresponding to the first area based on the received information concerning the discharging state of ink for an area for which processing is assigned to the first processing unit and a partial area for which processing is assigned to the second processing unit, and wherein the second processing unit includes a second receiving unit configured to receive information concerning the discharging state of ink on the recording head corresponding to the first area and information concerning the discharging state of ink on the recording head corresponding to the second area acquired by the acquisition unit, and a second generation unit configured to generate the recording image data from the divided data corresponding to the second area based on the received information concerning the discharging state of ink for an area for which processing is assigned to the second processing unit and a partial area for which processing is assigned to the first processing unit.

21. The apparatus according to claim 20, wherein the recording head has a structure in which a nozzle array corresponding to the first area and a nozzle array corresponding to the second area are continuously arrayed in a line.

22. The apparatus according to claim 20, wherein the recording head has a structure in which a nozzle array corresponding to the first area and a nozzle array corresponding to the second area are arranged at a predetermined distance in a direction orthogonal to an array direction of the nozzle arrays, and a preset number of nozzles are arranged so as to overlap each other in an array direction of the nozzle arrays.

23. The apparatus according to claim 20, wherein the acquisition unit acquires the information concerning a failure discharge nozzle, and wherein the control unit moves data, in the recording image data, which is assigned to the failure discharge nozzle to data of a nozzle which is adjacent to the failure discharge nozzle and configured to discharge ink.

24. The apparatus according to claim 20, wherein the divided data corresponding to the first area includes data for an area closed to boundary of the first and second areas, the first generation unit generates a tentative image data of the first area and a predetermined area which is in the second area and closed to boundary of the first and second area, and performing correction processing of the tentative image data using the information specifying the position of discharging failure nozzle to generate the recording image data for the first area.

25. The apparatus according to claim 20, wherein the divided data corresponding to the first area includes data in an area closed to boundary of the first and second areas.

26. The apparatus according to claim 25, wherein the first generation unit generates the recording image data for the first area based on the information indicating a discharge failure nozzle corresponding to an area closed to boundary of the first and second areas.

* * * * *